US006508537B2

(12) United States Patent
Yamada et al.

(10) Patent No.: US 6,508,537 B2
(45) Date of Patent: Jan. 21, 2003

(54) INK JET RECORDING DEVICE CAPABLE OF CONTROLLING IMPACT POSITIONS OF INK DROPLETS IN ELECTRICAL MANNER

(75) Inventors: Takahiro Yamada, Hitachinaka (JP); Shinya Kobayashi, Hitachinaka (JP); Kunio Satou, Hitachinaka (JP); Katsunori Kawasumi, Hitachinaka (JP); Kazuo Shimizu, Hitachinaka (JP); Hitoshi Kida, Hitachinaka (JP)

(73) Assignee: Hitachi Koki Co., Ltd., Tokyo (JP)

( * ) Notice: Subject to any disclaimer, the term of this patent is extended or adjusted under 35 U.S.C. 154(b) by 0 days.

(21) Appl. No.: 09/925,603

(22) Filed: Aug. 10, 2001

(65) Prior Publication Data

US 2002/0021324 A1 Feb. 21, 2002

(30) Foreign Application Priority Data

Aug. 11, 2000 (JP) ..... 2000-243686

(51) Int. Cl.[7] ..... B41J 2/155
(52) U.S. Cl. ..... 347/42; 68/77; 68/14
(58) Field of Search ..... 347/42, 13, 12, 347/14, 40, 68, 77, 78, 81, 82, 19

(56) References Cited

U.S. PATENT DOCUMENTS 4,219,822 A * 8/1980 Paranjpe ..... 347/42
6,183,063 B1 * 2/2001 Bolash et al. ..... 347/42

FOREIGN PATENT DOCUMENTS

JP HEI 9 262992 7/1997

* cited by examiner

*Primary Examiner*—Lamson Nguyen
(74) *Attorney, Agent, or Firm*—Whitham, Curtis, Christofferson, PC

(57) ABSTRACT

An ink jet recording device 10 includes a plurality of head modules 210 each formed with a plurality of nozzles for forming dots on a recording sheet 100. When the assembly of the head modules 210 has any positional error, recorded dots will shift to undesirable positions. However, the ink jet recording device 10 of the present invention adjust the dot forming positions to desirable positions in an electrical manner without actually and mechanically moving the head modules 210, both in directions perpendicular to and parallel with a nozzle line.

11 Claims, 15 Drawing Sheets

INK JET RECORDING DEVICE CAPABLE OF CONTROLLING IMPACT POSITIONS OF INK DROPLETS IN ELECTRICAL MANNER

BACKGROUND OF THE INVENTION

1. Field of the Invention

The present invention relates to an ink jet recording device capable of forming high-quality images at high speed by using a plurality of print-head modules.

2. Related Art

There has been proposed a serial-scanning type ink jet recording device including a recording head that forms dot images on an elongated recording sheet by ejecting ink droplets while scanning in a widthwise direction of the recording sheet. Specifically, the recording head produces, during a single scan, one-line worth of image, which includes a plurality of primary scanning lines. Then, the recording sheet is transported in its longitudinal direction, which is perpendicular to the widthwise direction, by a predetermined distance. Then, the recording head forms a next one-line worth of image. These operations are repeatedly performed, so that a whole image is completed.

In order to improve the image forming speed, the number of primary scanning lines that the recording head prints in a single scan may be increased. In this case, the recording head is configured to have a relatively large length in the lengthwise direction so that an increased number of nozzles, through which ink droplets are ejected, are formed thereto.

In another type of ink jet recording device, a recording head has a large width equivalent to an entire width of the recording sheet such that nozzles are formed for every one of a plurality of secondary scanning lines that extends in the longitudinal direction of the recording sheet. With this configuration, the recording head can form a complete image without moving in the widthwise direction at all.

There are various methods for producing this type of recording head with such a wide width. In one method, a line of a plurality of nozzles is formed to a wide-width recording head at once. However, in this method, if even only one of the nozzles is formed to have an irregular ink-ejection characteristics, quality of a whole image is greatly degraded, so this method requires a relatively high production cost.

In another method, a plurality of short-width head modules each formed with a plurality of nozzles are assembled to produce a single wide-width recording head. That is, a complete image is formed by a combination of a plurality of image-portions, which are formed by corresponding head modules. Because the short-width head modules are formed at a lower cost, the entire production costs can be reduced. However, this method requires an accurate assembly of the head modules.

Japanese Patent Application Publication (Kokai) No. HEI-9-262992 discloses a conventional method for accurate assembly of the head modules. In this method, actual printing is performed, and location information of each head module with respect to the widthwise direction is obtained. Then, based on the location information, the head module is mechanically moved to a proper position if there is any undesirable positional error. This mechanical movement is performed by using an adjusting unit.

Positions with respect to the lengthwise direction can be mechanically corrected in the same manner. However, with respect to the lengthwise direction, the positional error can be electrically corrected by using adjustment recording data, so a combination of mechanical method and electrical method is used for correcting the positional error of the head modules.

However, the above conventional method requires a complex adjusting unit to improve the accuracy of the positional adjustment. Also, automatic mechanical adjustment is not possible.

SUMMARY OF THE INVENTION

It is an objective of the present invention to overcome the above problems and also to provide an ink jet recording device including a plurality of head modules and capable of printing a high-quality image at a high speed rate and automatically and electrically correcting positional relationship among dot groups that are formed by the head modules.

In order to achieve the above and other objectives, there is provided an ink jet recording device including a plurality of head modules, a moving mechanism, ejection means, deflection means, and correcting means. The plurality of head modules are assembled side by side in a widthwise direction for forming dot groups on a recording medium. The dot groups are aligned in the widthwise direction to form a complete image. Each of the plurality of head modules is formed with a nozzle line extending in a line direction and including a plurality of nozzles through which ink droplets are ejected to form the corresponding dot group by forming corresponding dots on the recording medium. The moving mechanism moves the recording sheet relative to the plurality of head modules in a moving direction at an angle $\theta$ with respect to the line direction. The moving direction is perpendicular to the widthwise direction. A plurality of first scanning lines extending in the moving direction are defined on the recording medium. The ejection means selectively ejects ink droplets from the plurality of nozzles in an ejection direction at an ejection timing. The deflection means deflects the ejection direction of the ink droplets toward a deflection direction perpendicular to the line direction by one of predetermined deflection amounts. The correcting means corrects positional error of the dot groups. The correcting means includes first control means for controlling the predetermined deflection amounts so as to form the dots on the first scanning lines and second control means for controlling the ejection timing so as to adjust positions of the dots with respect to the moving direction.

In this configuration, there is no need to provide an additional separate unit for mechanically correcting head module assembly. The correction can be performed automatically by electrical means.

BRIEF DESCRIPTION OF THE DRAWINGS

In the drawings:

FIG. 3(*b*) is an explanatory view showing PZT driving signals applied to nozzles and corresponding deflection amounts of ink droplets;

FIG. 7(*b*) is a cross-sectional view taken along the line D—D of FIG. 2 where the center line is controlled shifted;

FIG. 8(*b*) is an explanatory view showing PZT driving signals applied to nozzles and corresponding deflection amounts of ink droplets;

FIG. 9(*b*) is a magnified view of FIG. 9(*a*);

FIG. 10(*b*) is a magnified view of FIG. 10(*a*);

FIG. 11(*b*) is a magnified view of FIG. 11(*a*);

FIG. 12(*b*) is a magnified view of FIG. 12(*a*);

FIG. 13(*b*) is an explanatory view showing charging-deflection control signals after the adjustment;

FIG. 13(*c*) is an explanatory view showing PZT driving signals applied to nozzles and corresponding deflection amounts of ink droplets;

FIG. 14(*b*) is an explanatory view showing PZT driving signals applied to nozzles and corresponding deflection amounts of ink droplets;

FIG. 16(*b*) is an explanatory view showing PZT driving signals applied to nozzles, corresponding ink-droplet generating timings, and corresponding ink-droplet deflection amounts.

PREFERRED EMBODIMENTS OF THE PRESENT INVENTION

Next, line-scanning type ink jet recording devices according to embodiments of the present invention will be described while referring to the accompanying drawings.

First, a configuration of an ink jet recording device 10 according to a first embodiment of the present invention will be described while referring to FIGS. 1 and 2. It should be noted that FIG. 2 is a magnified view of a region 1 indicated by a circle in FIG. 1.

An elongated uncut recording sheet 100 has a width in a first direction A and a length in a second direction B perpendicular to the first direction A, and is transported in the second direction B at a predetermined speed. The ink jet recording device 10 forms dots on scanning lines 110 on the recording sheet 100 at a dot density of Ds so as to form a dot image on the recording sheet 100 at a high speed.

Figure 1:
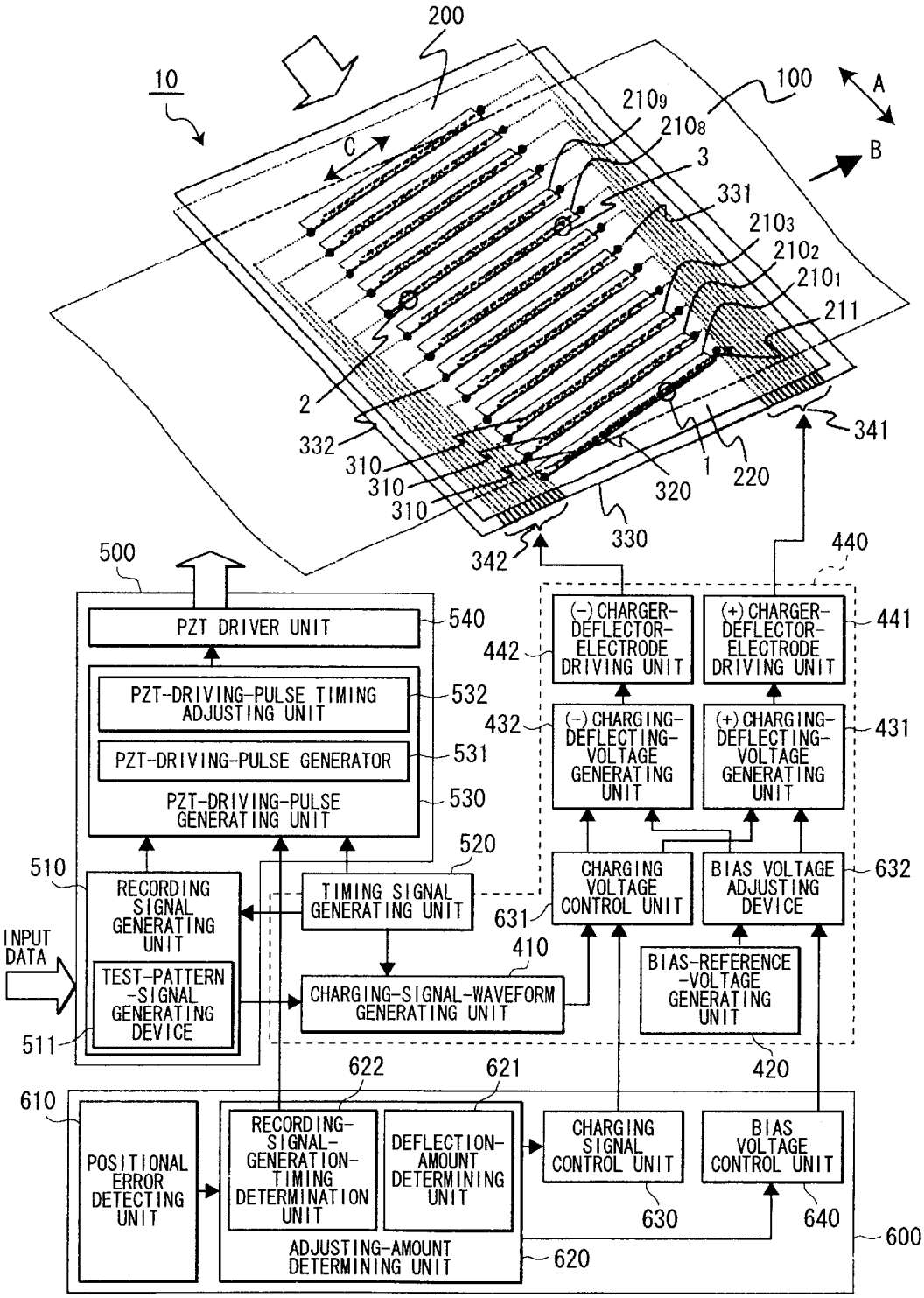
FIG. 1 is a plan view of main components, partially indicated in a block diagram, of an ink jet recording device according to a first embodiment of the present invention.
Figure 2:
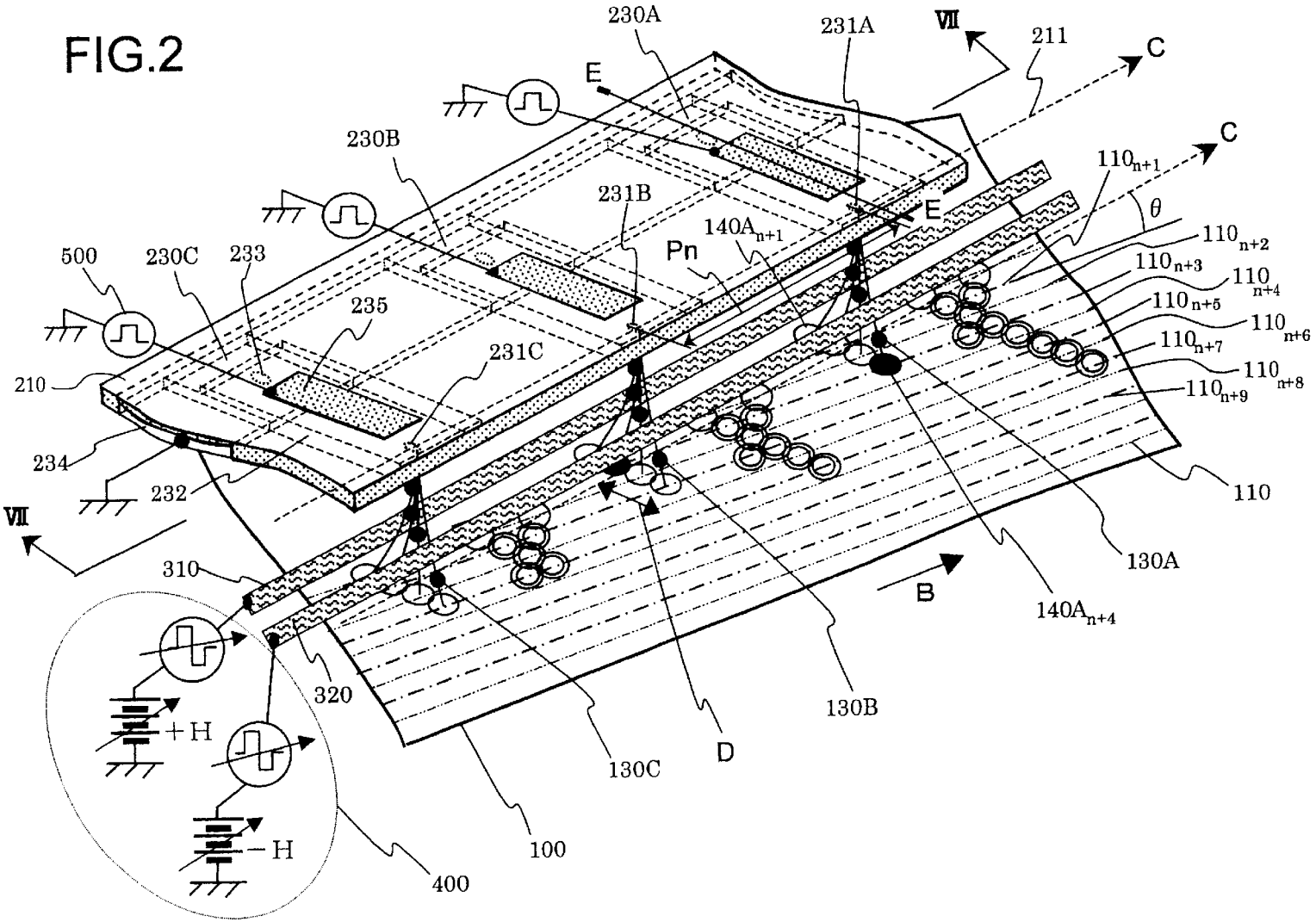
FIG. 2 is a magnified view of the components of FIG. 1.

As shown in FIGS. 1 and 2, the ink jet recording device 10 includes a recording head 200, which includes a plurality of head modules 210 arranged in the first direction A and a frame 220 for supporting the head modules 210. Each head module 210 has the same configuration, and is formed with n nozzles 230 each having a nozzle hole 231. The nozzles 230 are aligned in a third direction C at a nozzle-hole pitch of Pn, and defines a nozzle line 211 extending in the third direction C.

Each nozzle 230 has the same configuration and has an ink chamber 232 with the nozzle hole 231, an ink supply port 233 for introducing ink into the ink chamber 232, and a manifold 234 for supplying the ink to the ink supply port 233. The ink chamber 232 is provided with an piezoelectric element 235 serving as an actuator, which changes a volume of the ink chamber 232 when applied with recording signals. The recording head 200 is positioned 1 mm through 2 mm above the recording sheet 100 in a manner that the nozzle holes 231 faces the recording sheet 100.

In the present embodiment, the scanning lines 110 extend in the second direction B and have a line density Ds of 600 dpi in the first direction A. The angle θ of the third direction C with respect to the second direction B is approximately 14.04 degrees ($\tan\theta=\tan^{-1}(1/4)$). The nozzle-hole pitch Pn is $2/600(\sin\theta)^{-1}$ inches. That is, a distance between two adjacent nozzle holes 231 is approximately 0.013 inches. The number n of nozzles 230 is 96. 13 head modules 210 are used, which is sufficient for covering over the entire width of recording head 200. Accordingly, a nozzle-hole pitch in the first direction A is $8/600$ inches, and the nozzle holes 231 are positioned to correspond every other scanning lines 110.

Next, deflection control means of the ink jet recording device 10 will be described. The deflection control means includes a plurality of pairs of electrodes 310, 320, a substrate 330, and a charging-deflecting control-signal generating unit 400. Each pair of electrodes 310, 320 are provided between the recording sheet 100 and the recording head 200 and sandwich a corresponding one of the nozzle lines 211 therebetween. The electrode 310 serves as a positive-polarity charger-deflector electrode, and the electrode 320 serves as a negative-polarity charger-deflector electrode. Leads 331, 332 extend from the electrodes 310, 320 and connected to a positive-polarity charger-deflector-electrode terminal 341 and a negative-polarity charger-deflector-electrode terminal 342, respectively, which are provided on the substrate 330.

The charging-deflecting control-signal generating unit 400 is for applying charging-deflecting control signals to the electrodes 310, 320, and includes a charging-signal-waveform generating unit 410, a bias-reference-voltage generating unit 420, charging-deflecting-voltage generating units 431, 432, and charger-deflector-electrode driving units 441, 442.

The charging-signal-waveform generating unit 410 generates an AC voltage component of the charging-deflecting control signals. The bias-reference-voltage generating unit 420 generates a bias voltage, which is for generating a DC voltage component of the charging-deflecting control signals and for generating a deflector electrostatic field. Based on the charging signal waveform of the AC voltage component and the bias voltage, the charging-deflecting-voltage generating units 431, 432 generate the charging-deflecting control signals. The charger-deflector-electrode driving units 441, 442 amplify the charging-deflecting control signals to a predetermined voltage level. The amplified charging-deflecting control signals are output to the electrodes 310, 320.

Next, an ink-ejection control-signal generating unit 500 of the ink jet recording device 10 will be described. The ink-ejection control-signal generating unit 500 includes a recording signal generating unit 510, a timing signal generating unit 520, a PZT-driving-pulse generating unit 530, and a PZT driver unit 540. The recording signal generating unit 510 generates pixel data of images based on input data. The timing signal generating unit 520 generates a timing signal. The PZT-driving-pulse generating unit 530 generates a PZT driving pulse for each nozzle 230 based on the pixel data and the timing signal. The PZT driver unit 540 amplifies the PZT driving pulse to a sufficient signal level, and outputs the amplified PZT driving pulse to the piezoelectric element 235 of each nozzle 230, so that an ink droplet is ejected from the nozzle 230 at a proper timing.

The PZT-driving-pulse generating unit 530 includes a PZT-driving-pulse generator 531 and a PZT-driving-pulse timing adjusting unit 532. The PZT-driving-pulse generator 531 generates a PZT driving pulse signal, which is used in single-pixel/plural-nozzle printing for forming a single dot by a plurality of nozzles 230. The PZT-driving-pulse timing adjusting unit 532 controls a generation timing of the PZT driving pulse signal such that ink droplets ejected from a plurality of nozzles 230 in response to the PZT driving pulse signal will impact on or near a target pixel position to form a single dot.

Next, a recorded-dot-group position control unit 600 of the ink jet recording device 10 will be described. The recorded-dot-group position control unit 600 controls the positional relationship among dot groups recorded by a plurality of head modules 210. As shown in FIG. 1, the position control unit 600 includes a positional error detecting unit 610, an adjusting-amount determining unit 620, a charging signal control unit 630, a bias voltage control unit 640, a charging voltage control unit 631, and a bias voltage adjusting device 632.

The positional error detecting unit 610 detects an amount of distance between an actual dot position and a target pixel position. The adjusting-amount determining unit 620 determines an adjusting amount based on the detected distance and outputs adjustment information to both the charging signal control unit 630 and the bias voltage control unit 640.

The adjusting-amount determining unit 620 includes a deflection-amount determining unit 621 and a recording-signal-generation-timing determination unit 622. The deflection-amount determining unit 621 determines how much deflection is necessary for adjusting the positional error of the recorded dot. The recording-signal-generation-timing determination unit 622 determines an amount of timing shift, which the generation timing of the recording signal is shifted by.

Upon receipt of the adjustment information from the adjusting-amount determining unit 620, the charging signal control unit 630 and the bias voltage control unit 640 output control signals to control the charging voltage control unit 631 and the bias voltage adjusting device 632 to properly adjust the charging-deflecting control signals applied to the electrodes 310, 320.

Figure 3A:
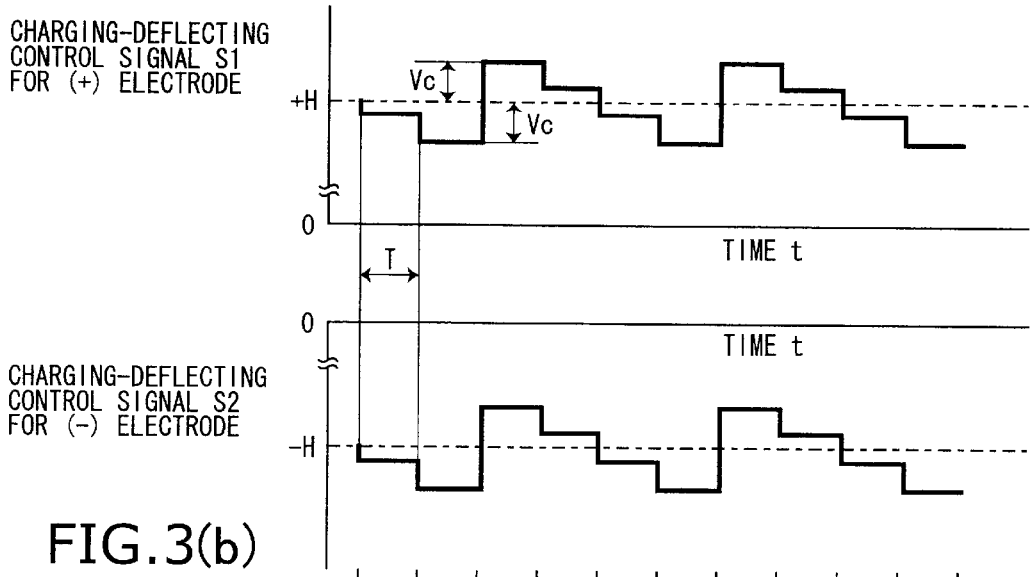
FIG. 3(*a*) is an explanatory view showing charging-deflection control signals applied to charger-deflector electrodes of the ink jet recording device.
Figure 3B:
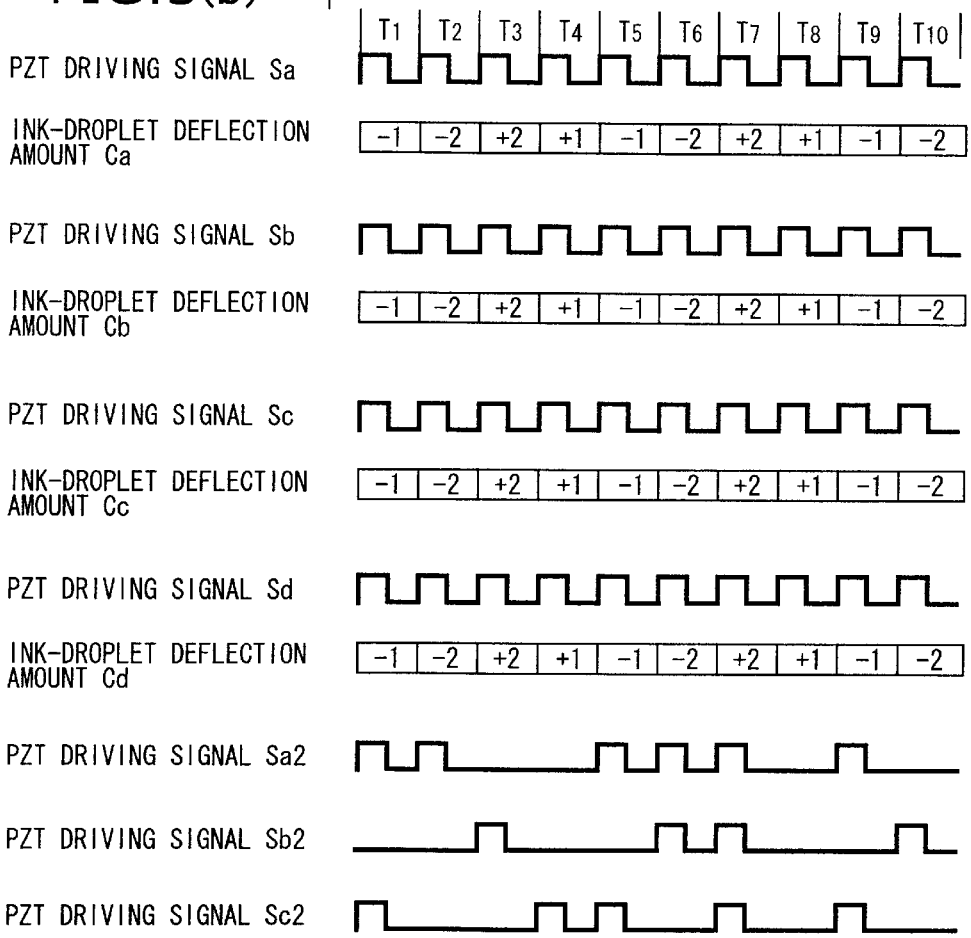
Figure 4:
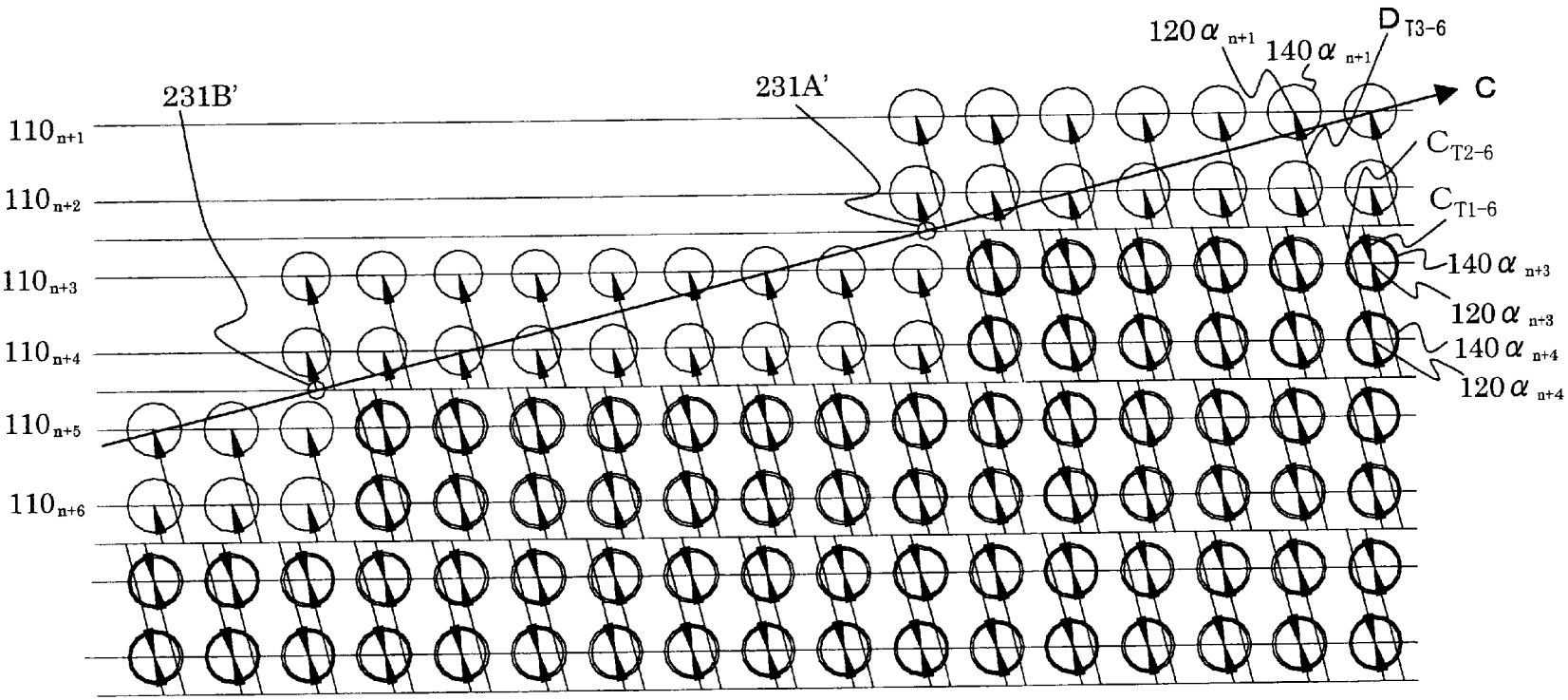
FIG. 4 is an explanatory view showing dots formed on a recording sheet.

Next, printing operations of the ink jet recording device 10 will be described while referring to FIGS. 1 through 4. In this example, the printing operations are performed for forming an all-black image, that is, for forming dots on every pixels on the recording sheet 100. FIG. 3(*a*) shows the charging-deflecting control signals S1 and S2 applied to the electrodes 310 and 320, respectively. FIG. 3(*b*) shows PZT driving signals Sa through Sc2 used for the all-black image printing operations and also ink-droplet deflection amounts Ca through Cd. FIG. 4 shows dots recorded on the recording sheet 100 by the operation.

When the electrode 310 for a positive polarity is applied with the charging-deflecting control signals S1, a deflector voltage of +H and a charging voltage are applied to the electrode 310. Similarly, when the electrode 320 for a negative polarity is applied with the charging-deflecting control signals S2, a deflector voltage of −H and the charging voltage are applied to the electrode 320. Accordingly, an electric charger field for charging ink droplets 130 and an electrostatic deflector field for deflecting the charted ink droplets 130 are generated.

The magnitude of H of the deflector voltages is determined at the bias voltage adjusting unit 632 by adjusting, based on the control signal output from the bias voltage control unit 640, the bias voltage generated at the bias reference voltage generating unit 420, and the changing amount of Vc of the charging voltage is determined at the charging voltage control unit 631 by adjusting, based on the control signal output from the charging signal control unit 630, the charging signal waveform generated at the charging-signal-waveform generating unit 410 by the charging signal waveform voltage generated by the charging-signal-waveform generating unit 410.

The ink held in the recording head 200 is connected to the ground, i.e., has 0 V. Therefore, the charging voltage is applied between an ink droplet 130 and the electrodes 310, 320 at the time of when the ink droplet 130 is about to be ejected from the nozzle hole 231. Because the ink has an excellent conductivity of lower than several hundreds Ω cm, at the time of when the ink droplet 130 separates from the rest of the ink, the ink droplet 130 is charged by an amount in accordance with the charging voltage applied at that moment. Then, the charged ink droplet 130 flies toward the recording sheet 100. Before impact on the recording sheet 100, the ink droplet 130 is deflected within the electrostatic deflector field toward a forth direction D perpendicular to the third direction C (FIG. 2).

Referring to FIG. 2, an ink droplet 130A ejected from a nozzle hole 231A is capable of impacting on any scanning lines $\mathbf{110}_{n+1}$ through $\mathbf{110}_{n+4}$ depend on its deflection amount, and therefore forming any dot $\mathbf{140A}_{n+1}$ to $\mathbf{140}_{n+4}$. Similarly, an ink droplet 130B ejected from a nozzle hole 231B is capable of impacting on any scanning lines $\mathbf{110}_{n+3}$ through $\mathbf{110}_{n+6}$ by deflection, and an ink droplet 130C from a nozzle hole 231C is deflected to impact on any scanning lines $\mathbf{110}_{n+5}$ through $\mathbf{110}_{n+8}$. That is, the ink droplets 130A and 130B from two different nozzle holes 231A and 231B are able to impact on the single scanning line $\mathbf{110}_{n+4}$. The same is true for any other scanning lines 110, and ink droplets 130 from two different nozzle holes 231 are able to impact on a single scanning line.

The recording operations will be described further in more detail. It should be noted that as described above the PZT driving signals Sa through Sc2 of FIG. 3(*b*) are applied to the piezoelectric elements 235 for ejecting ink droplets 130. FIG. 4 shows dots formed on the recording sheet 100 and projections 231A', 231B' of the nozzle holes 231A and 231B of FIG. 2.

As shown in FIGS. 3(*a*) and 3(*b*), at the time T1, the charging voltage is −⅓Vc. Accordingly, an ink droplet 130A ejected from the nozzle hole 231A at the time T1 is deflected in the forth direction D along a line $D_{T1-6}$ of FIG. 4, for example, and impacts on a pixel 120 $_{\alpha n+3}$ on the scanning line $\mathbf{110}_{n+3}$, and forms a dot $\mathbf{140}_{\alpha n+3}$ thereon. At a subsequent time T2, the charging voltage is −Vc. Accordingly, an ink droplet 130A ejected at the time T2 is deflected in the forth direction D along a line $D_{T2-6}$, for example, and impacts on a pixel $\mathbf{120}_{\alpha n+4}$ on the scanning line $\mathbf{110}_{n+4}$, and forms a dot $\mathbf{140}_{\alpha n+4}$ thereon. At the time T3, the charging voltage is +Vc. An ink droplet ejected at the time T3 is deflected in the forth direction D along a line $D_{T3-6}$, for example, and impacts on a pixel $\mathbf{120}_{\alpha n+1}$, on the scanning line $\mathbf{110}_{n+1}$, thereby forming a dot $\mathbf{140}_{\alpha+1}$. In this manner, ink droplets 130A ejected from the nozzle hole 231A are deflected and able to impact on every pixel on the four scanning lines $\mathbf{110}_{n+1}$ through $\mathbf{110}_{n+4}$.

In the same manner, ink droplets ejected from other nozzle holes 231, such as nozzle holes 231B, 231C, are deflected and impact on every pixel on corresponding four scanning lines 110. Therefore, after an ink droplet 130B from the nozzle hole 231B impacts and forms a dot on a pixel $\mathbf{120}\alpha_{n+3}$, for example, an ink droplet 120A from the nozzle hole 231A impacts on the same pixel $\mathbf{120}\alpha_{n+3}$ after scanning. Dots are formed on any other pixels in the same manner. That is, a single dot is formed by two ink droplets 130 ejected from two adjacent nozzle holes 231. In this manner, an all-black image is formed.

As shown in FIG. 4, the resultant all-black image is formed from a plurality of dots arranged in both the first direction A and the second direction B at a predetermined interval on the recording sheet 100.

The PZT driving pulse signals Sa2 through Sc2 are example of those that are generated when an image other than the all-black image is formed. Ink droplets 130 are ejected at a corresponding proper timing and deflected.

Each head module 210 with a limited width forms only a part of a complete image, the part extending in the second direction B in a band shape. Therefore, the complete image is formed by a combination of the band-shaped image parts.

Figure 5:
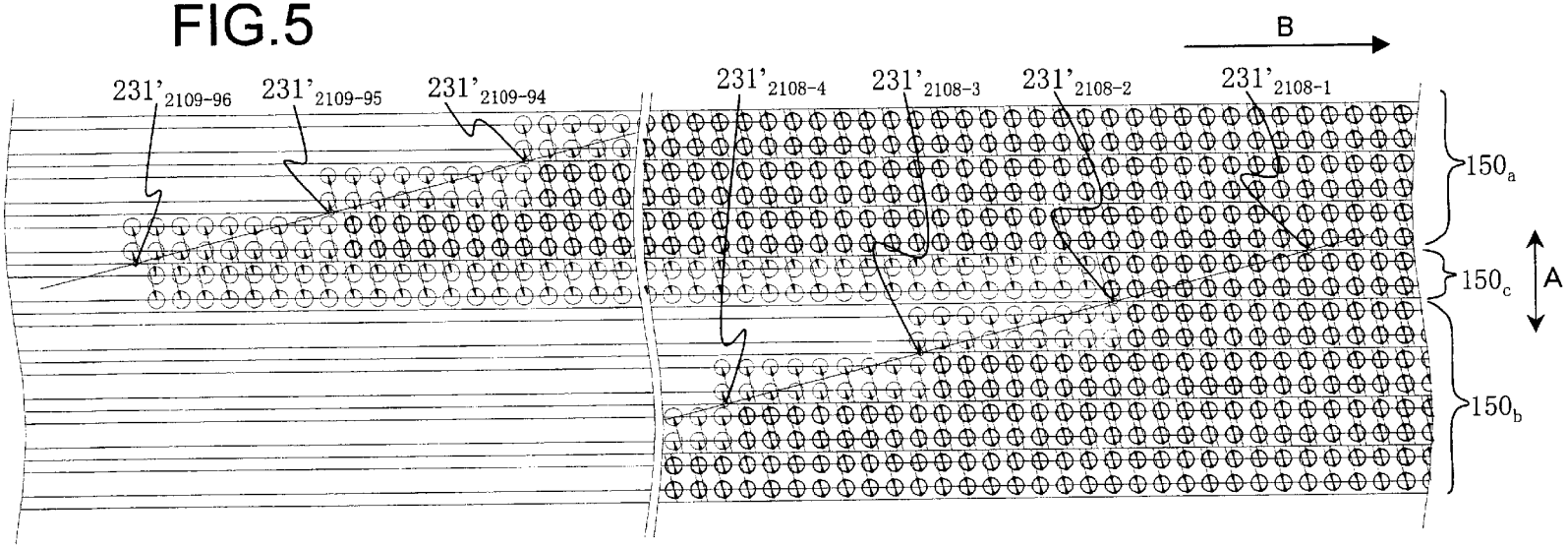
FIG. 5 is an explanatory view showing dots properly formed by two adjacent head modules.

FIG. 5 shows two dot groups formed by two adjacent head modules 210 in a proper manner. Projections $\mathbf{231}'_{2109-94}$, $\mathbf{231}'_{2109-95}$, $\mathbf{231}'_{2109-96}$ of nozzle holes $\mathbf{231}_{2109-94}$, $\mathbf{231}_{2109-95}$, $\mathbf{231}_{2109-96}$ at the left end portion of the head module $\mathbf{210}_9$ (FIG. 1), and projections $\mathbf{231}'_{2108-1}$, $\mathbf{231}'_{2108-2}$, $\mathbf{231}'_{2108-3}$, $\mathbf{231}'_{2108-4}$ of nozzle holes $\mathbf{231}_{2108-1}$, $\mathbf{231}_{2108-2}$, $\mathbf{231}_{2108-3}$, $\mathbf{231}_{2108-4}$ at the right end portion of the head module $\mathbf{210}_8$ are also shown in FIG. 5.

In FIG. 5, a dot group 150*a* extending in the second direction B is formed by ink droplets 130 from the nozzle holes $\mathbf{231}_{2109-94}$, $\mathbf{231}_{2109-95}$, $\mathbf{231}_{2109-96}$ of the head module $\mathbf{210}_9$. A dot group 150*b* is formed by ink droplets 130 from the nozzle holes $\mathbf{231}_{2108-2}$, $\mathbf{231}_{2108-3}$, $\mathbf{231}_{2108-4}$ at the right portion of the head module $\mathbf{210}_8$. A dot group 150*c* is formed by the ink droplets 130 from the nozzle hole $\mathbf{231}_{2109-96}$ of the head module $\mathbf{210}_9$ and the nozzle hole $\mathbf{231}_{2108-2}$ of the head module $\mathbf{210}_8$. That is, dots within the dot group 150*c* are formed by ink droplets 130 from the nozzle hole $\mathbf{231}_{2109-96}$ and the nozzle hole $\mathbf{231}_{2108-2}$ overlapped one on the other.

Because of the proper ejection and deflection, the ink droplets 130 from two nozzle-holes $\mathbf{231}_{2109-96}$ and $\mathbf{231}_{2108-2}$ have properly impacted on target pixels, so that the dots in the dot group 150*c* are formed in the same proper condition as that in the dot groups 150*a* and 150*b*. As a result, the boundary between the dot groups 150*a* and 150*c* and the boundary between the dot groups 150*b* and 150*c* are unrecognizable.

These unnoticeable boundaries are proof of proper positional relationships between the head modules $\mathbf{210}_8$ and $\mathbf{210}_9$ and proper ink ejection and deflection of ink droplets 130.

Figure 6:
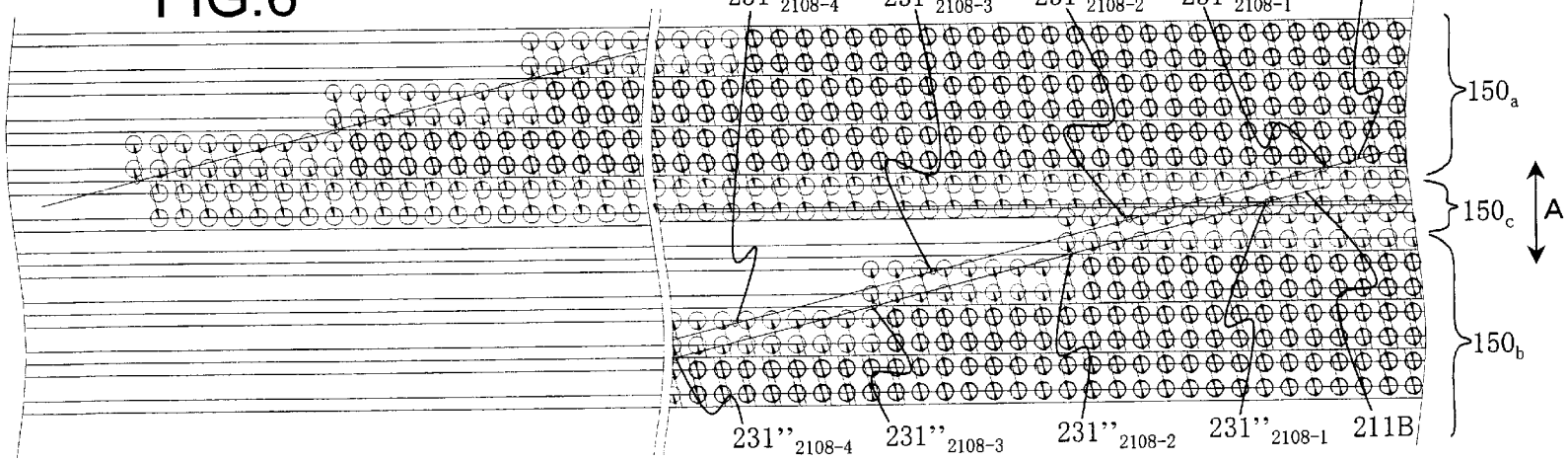
FIG. 6 is an explanatory view showing dots improperly formed by the two adjacent head modules.

In contrast to FIG. 5, FIG. 6 shows an example of undesirable printing result where the head modules $\mathbf{210}_8$ and $\mathbf{210}_9$ are in an improper positional relationship although the ink ejection and deflection of ink droplets 130 are properly performed. In the example of FIG. 6, the position of the head module $\mathbf{210}_8$ is shifted in the first direction A from an ideal position where the head module $\mathbf{210}_8$ is supposed to be. As a result, the nozzle line 211 of the head module $\mathbf{210}_8$ extends on a line 211B, which differs from an ideal line 211A, on which the nozzle line 211 is supposed to extend. Accordingly, projections 231" of the nozzle holes 231 are positioned at a lower left of the proper projections 231' shown in FIG. 5.

In this condition, dots formed by the head module $\mathbf{210}_8$ are all shifted to the lower left from the target pixels, so the ejected ink droplets 130 hardly overlap one on the other within the dot group 150*c*. As a result, a recording condition, such as color density, in the dot group 150*c* will differ from that of the dot groups 150*a* and 150*b*, and an undesirable visible line extending in the second direction B is formed to a resultant image on the recording sheet 100.

According to the present invention, the above-described positional error of the head modules 210 is corrected by a following electrical manner without actually and mechanically moving the head modules 210.

Figure 7A:
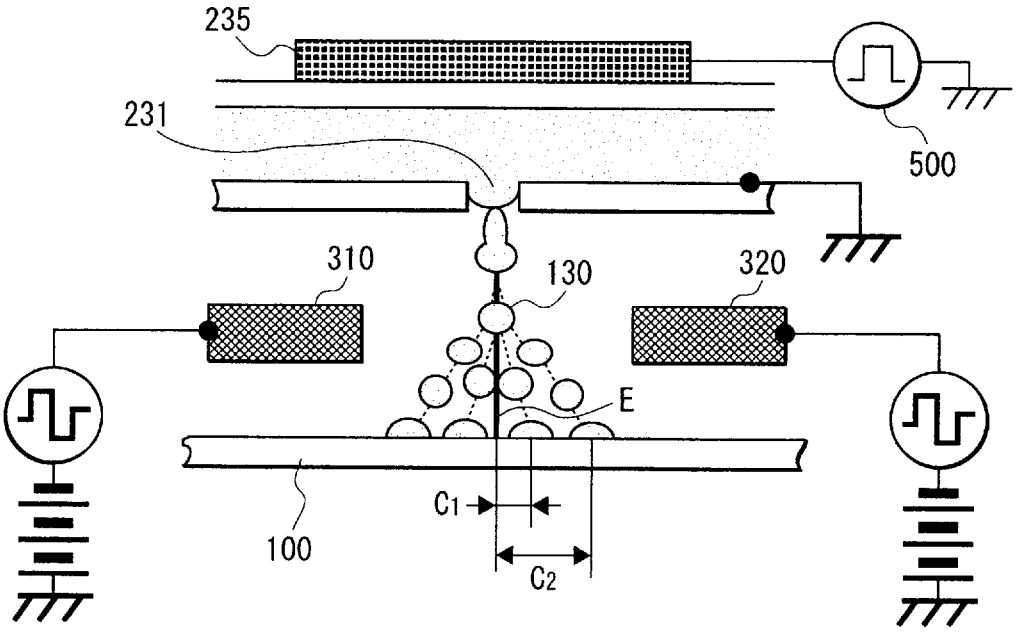
FIG. 7(*a*) is a cross-sectional view taken along a line D—D of FIG. 2 where a center line is unchanged.
Figure 7B:
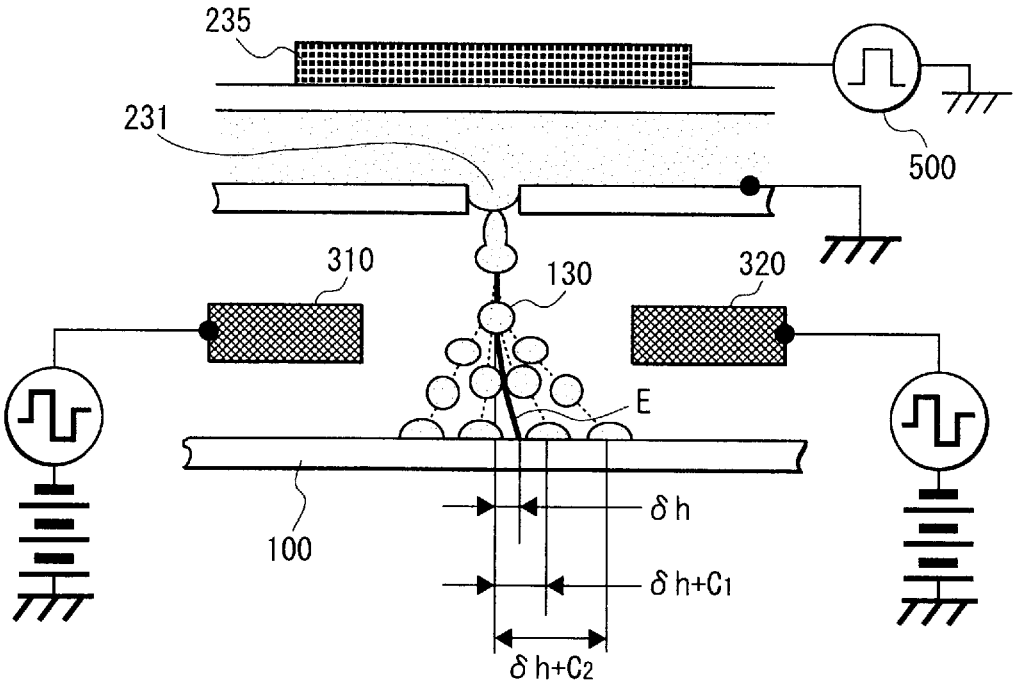

FIGS. 7(*a*) and 7(*b*) are cross-sectional views both taken along the line VII—VII of FIG. 3. FIG. 7(*a*) shows a usual ink-droplet deflection, and FIG. 7(*b*) shows an ink-droplet deflection after the positional error has been adjusted in the manner of the present embodiment. Details will be described below for this adjustment.

As described above, the electrodes 310, 320 are provided to each side of the nozzle hole 231 at positions equally separated therefrom. The electrodes 310, 320 are, as shown in FIG. 3(*a*), applied with the deflector voltage of ±H and the charging voltage that changes by an amount of within 2Vc. With this arrangement, as shown in FIG. 7(*a*) and described above, an ink droplet 130 ejected from a single nozzle hole 231 is controlled to impact on any one of four impact positions, two on one side of a center line E and two on the other side. The center line E represents a center of the orbits of the ejected ink droplet 130. The deflection amount is C1 when the ink droplet 130 is defected by a first deflection level, and is C2 when deflected by a second deflection level.

On the other hand, in FIG. 7(*b*), the center line E is shifted by an amount of δh compared with FIG. 7(*a*) as a result of the positional adjustment according to the present embodiment. Accordingly, impact positions of ink droplets 130 from the nozzle hole 231 shift by the amount δh from that shown in FIG. 7(*a*). Such a shift of the center line E is achieved by using the charging-deflection control signals S11 and S12 shown in FIG. 8(*a*).

Figure 8A:
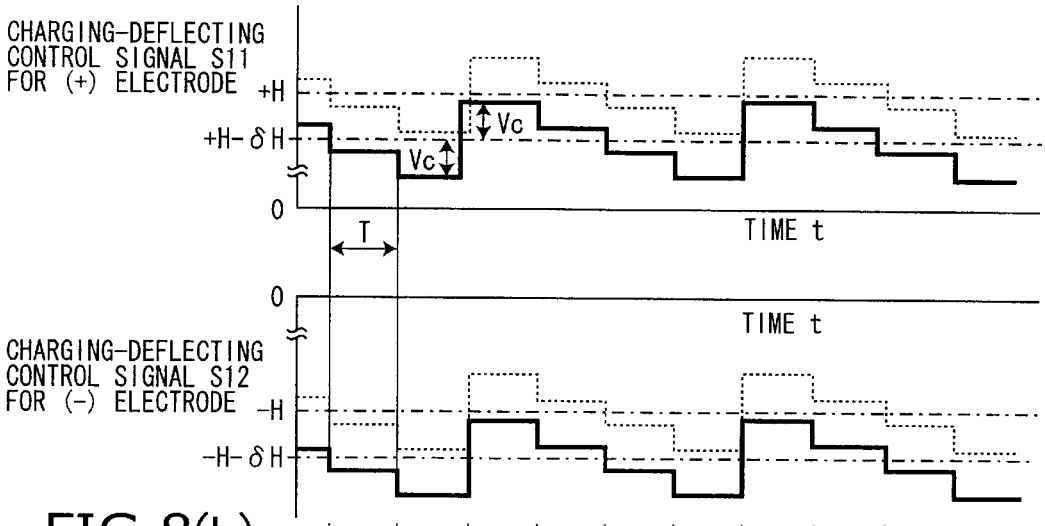
FIG. 8(*a*) is an explanatory view showing charging-deflection control signals applied to the charger-deflector electrodes of the ink jet recording device.
Figure 8B:
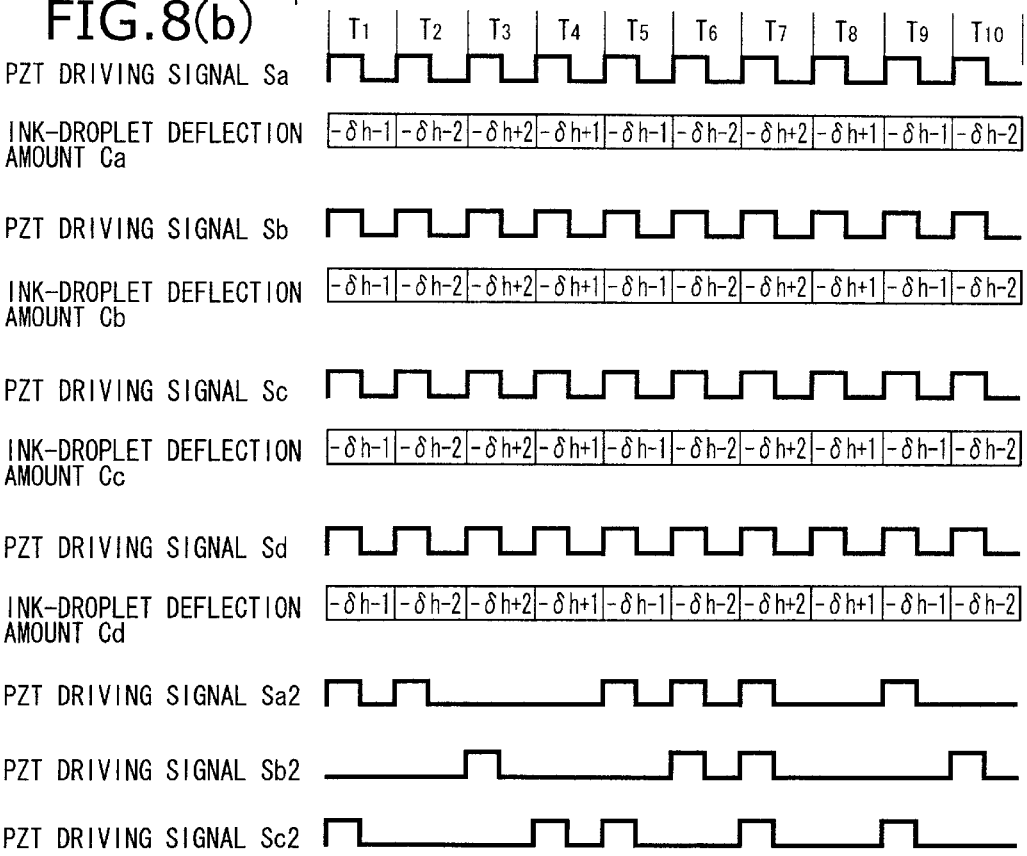
Figure 9A:
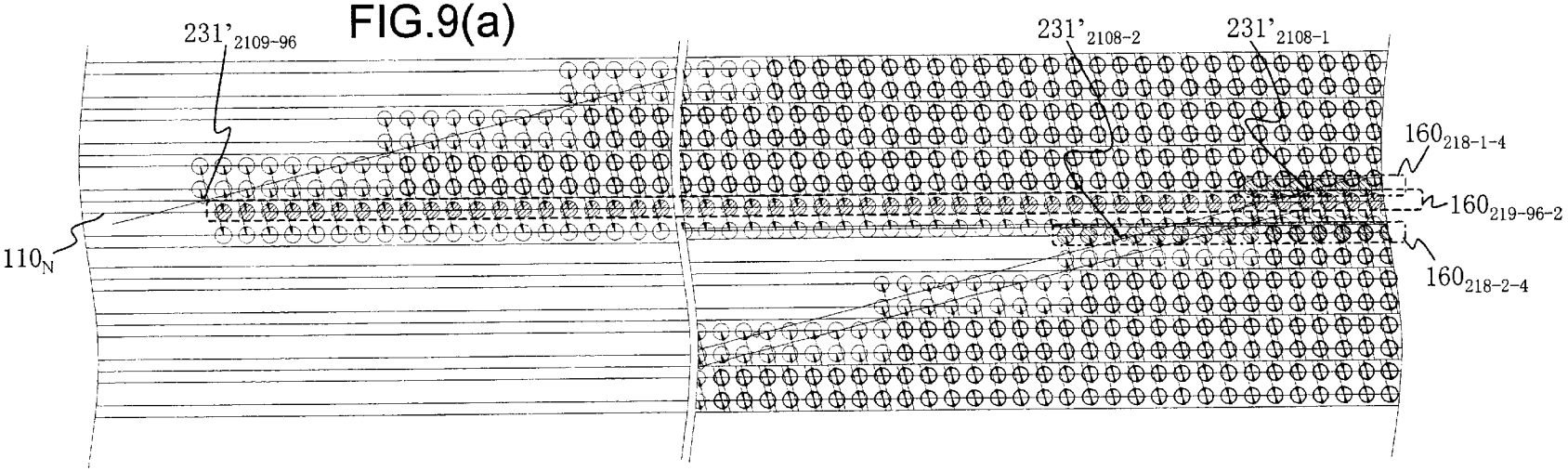
FIG. 9(*a*) is an explanatory view of dots formed by a test pattern printing operation.
Figure 9B:
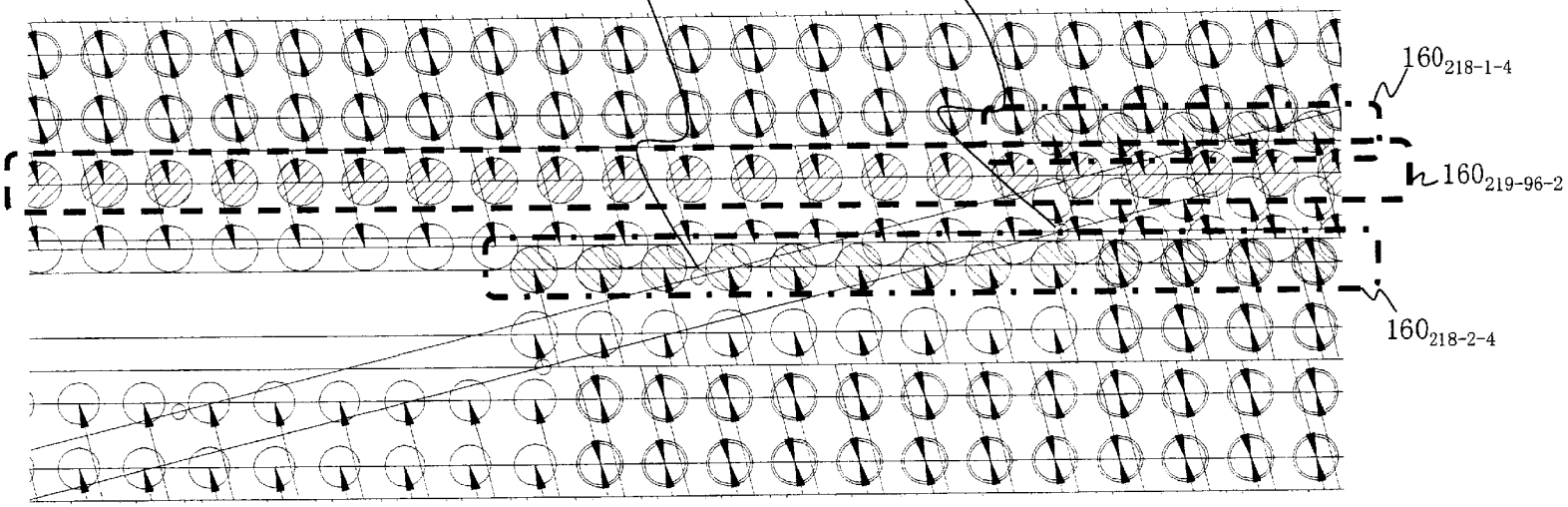

As shown in FIG. 8(*a*), in both the charging-deflation control signals S11 and S12 applied to the electrodes 310, 320, a waveform of the charging signal is shifted by an amount δH in the negative direction. An original waveform of the charging signal is indicated by a dotted line. The shift of the waveform of the charging signal is achieved by the bias voltage adjusting unit 632 based on a command from the bias voltage control unit 640 shown in FIG. 1. This results in no difference in the magnitude of the electric deflector field generated between the electrodes 310, 320. However, although a magnitude of the potential generated by the deflector voltage near the nozzle hole 231 is zero when applied with the usual signals S1 and S2, the magnitude will change not to zero when applied with the corrected signals S11 and S12. Accordingly, all the ink droplets 130 ejected from the nozzle hole 231 are positively charged by a voltage of −δh applied to the electrodes 310, 320, and so the flying orbits of the ink droplets 130 shift toward the electrode 320 having a negative polarity. At the same time, the ink droplets 130 are charged by the charging-waveform signal component of the signals S11, S12 in the same manner as before the adjustment. As a result, the deflection amounts Ca through Cd are also changed by the amount of δh as shown in FIG. 8(*b*), and so the flying orbits are shifted toward the electrode 320 as shown in FIGS. 9(*a*) and 9(*b*).

It should be noted that the amount of δh approximately equals to δH(C2/Vc), so the amount of δh can be controlled by control of the amount of δH.

As described above, according to the present invention, the positional error among the plurality of head modules 210 can be electrically adjusted without mechanically moving the head modules 210. Therefore, there is no need for an additional complex unit to adjusting the positional error.

Next, operations for adjusting the undesirable printing condition of FIG. 6 to a proper printing condition in the above-described adjustment method will be described. In the present embodiment, the adjustment is performed by printing a test pattern.

First, each head module 210 is adjusted to form dots on predetermined pixel positions. For example, the positional error detecting unit 610 outputs a command to a test-pattern-signal generating device 511 provided to the recording signal generating unit 510. Then, the test pattern generating device 511 controls the head modules 210 to form a test pattern. When recorded dots have any positional error, then the positional error detecting unit 610 detects an amount of error. The deflection-amount determining unit 621 of the adjusting-amount determining unit 620 determines an amount of adjustment, based on how the charging signal control unit 630 drives the charging voltage control unit 631 to adjust the charging deflection control signals in a manner shown in FIG. 3(*a*).

Next, a positional error with respect to the first direction A is adjusted. A test dot pattern is formed on the recording sheet 100. That is, the positional error detecting unit 610 outputs a command to the test-pattern-signal generating device 511 to generate signals, based on which a nozzle 230 of a nozzle hole $\mathbf{231}_{2109\text{-}96}$, shown in FIGS. 9(*a*) and 9(*b*), provided at the left most end of the head modules $\mathbf{210}_9$ in FIG. 1 is driven to eject ink droplets so as to form dots on a scanning line 110 that is allocated to both a nozzle hole 231 at the right most end of the head modules $\mathbf{210}_8$ and the nozzle hole $\mathbf{231}_{2109\text{-}96}$. In this example, a recorded-dot line $\mathbf{160}_{219\text{-}96\text{-}2}$ is formed on a canning line $\mathbf{110}_N$. At the same time, a recorded-dot line, which is supposed to be formed overlapped on the recorded-dot line $\mathbf{160}_{219\text{-}96\text{-}2}$, is formed by the nozzle hole 231 at the right end of the head modules $\mathbf{210}_8$.

It should be noted that in the present embodiment the head modules $\mathbf{210}_8$ and $\mathbf{210}_9$ are arranged such that the nozzle hole 231 at the right most end of the head modules $\mathbf{210}_8$ and the nozzle hole $\mathbf{231}_{2109\text{-}96}$ overlap with respect to the first direction A, in order to reduce the amount of δh and also to cope with a relatively large amount of positional error between the adjacent head modules 210.

Next, dot lines are formed by a plurality of candidate nozzle holes 231. In this example, recorded-dot lines $\mathbf{160}_{218\text{-}1\text{-}4}$ and $\mathbf{160}_{218\text{-}2\text{-}4}$ are formed by the nozzle hole $\mathbf{231}_{2108\text{-}1}$ and $\mathbf{231}_{2108\text{-}2}$, respectively.

Figure 10A:
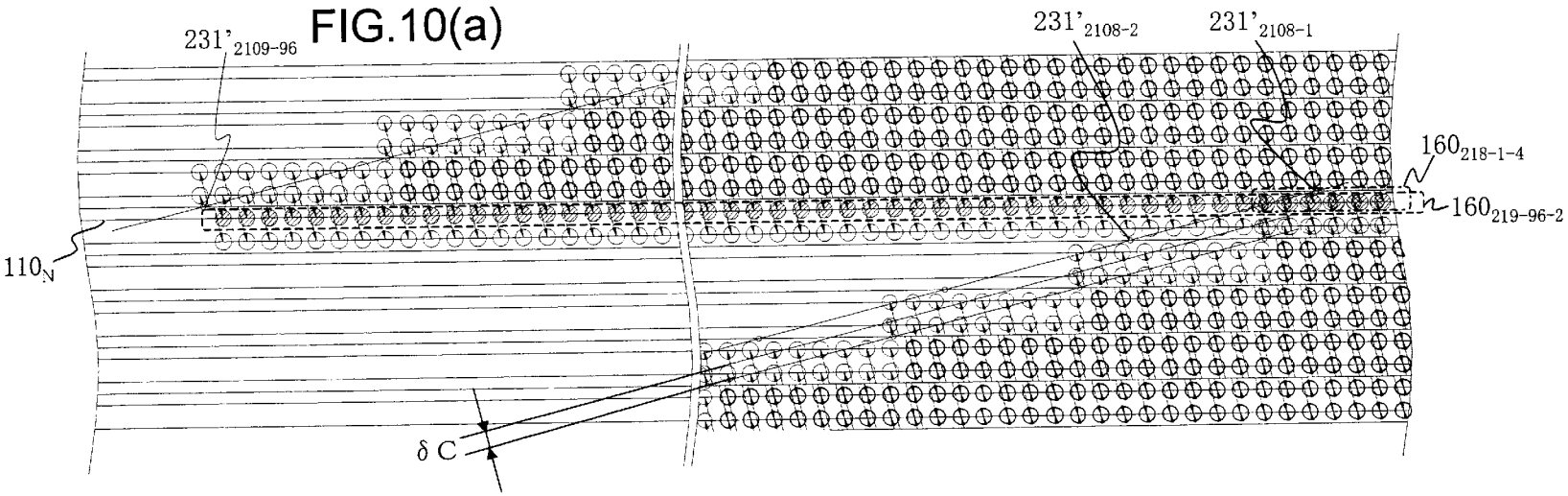
FIG. 10(*a*) is an explanatory view showing dots formed by adjusted printing operations shown in FIG. 8.
Figure 10B:
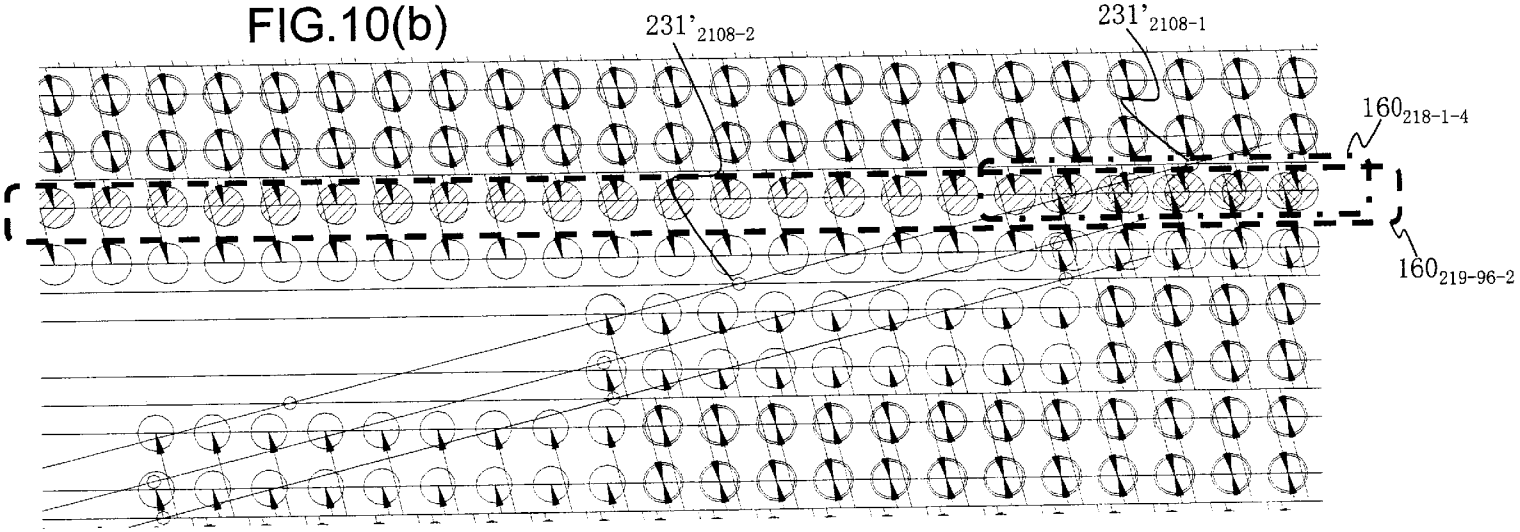

Although not shown in the drawings, a sensor is provided at downstream of the recording sheet 100 for detecting the printing result. Based on the detection results, the positional error detecting unit 610 determines which one of the recorded-dot lines $\mathbf{160}_{218\text{-}1\text{-}4}$ and $\mathbf{160}_{218\text{-}2\text{-}4}$ is closer to the recorded-dot line $\mathbf{160}_{219\text{-}96\text{-}2}$. Because the recorded-dot line $\mathbf{160}_{218\text{-}1\text{-}4}$ is closer in this example, the recorded-dot line $\mathbf{160}_{218\text{-}1\text{-}4}$ is adjusted to be formed overlapping the recorded-dot line $\mathbf{160}_{219\text{-}96\text{-}2}$ in a manner shown in FIGS. 10(*a*) and 10(*b*).

This adjustment is achieved in the manner described above while referring to FIG. 7, where the adjustment voltage δH is set approximately equal to $\delta h(Vc/C_2)$. That is, the deflection-amount determining unit 621 of the adjusting-amount detection unit 620 determines a value of the adjustment voltage δH. The bias voltage adjusting device 632 adjusts a bias voltage received from the bias reference voltage generating unit 420 based on a command from the bias voltage control unit 640. Then, charging-deflecting control signals shown in FIG. 8(*a*) are generated based on the adjusted bias voltage. This completes an adjustment with respect to the first direction A.

Figure 11A:
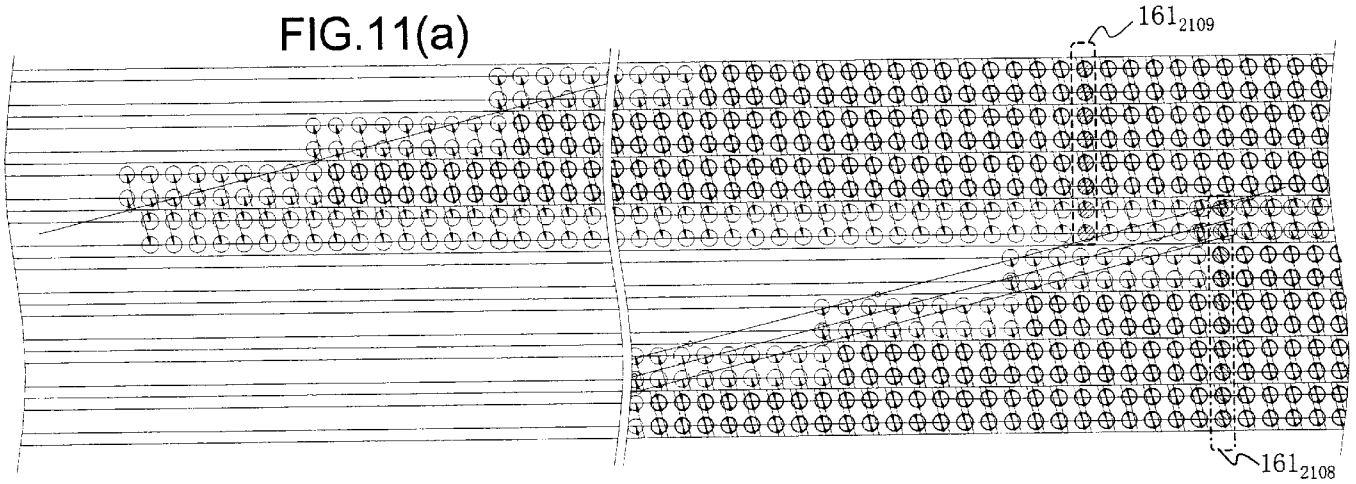
FIG. 11(*a*) is an explanatory view of dots formed by a test pattern printing operation.
Figure 11B:
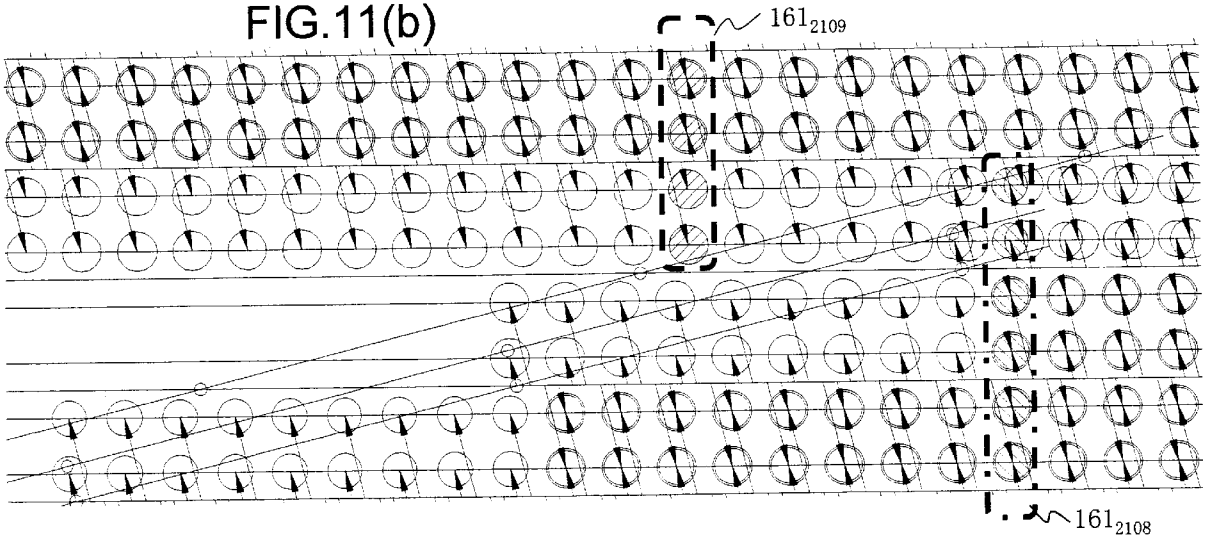

Next, a positional error with respect to the second direction B is adjusted. As shown in FIGS. 11(*a*) and 11(*b*), one of recorded-dot lines extending in the first direction A perpendicular to the second direction B is formed by the left end nozzle hole $\mathbf{231}_{2109\text{-}96}$ of the head module $\mathbf{210}_9$. In the present example, the recorded-dot line $\mathbf{161}_{2109}$ is formed. At the same time, a recorded-dot line $\mathbf{161}_{2108}$ is formed by the right end nozzle hole $\mathbf{231}_{2108\text{-}1}$ of the head module $\mathbf{210}_8$. The recorded-dot line $\mathbf{161}_{2108}$ is supposed to be formed in alignment with the recorded-dot line $\mathbf{161}_{2109}$. However, these two recorded-dot lines $\mathbf{161}_{2108}$ and $\mathbf{161}_{2109}$ are not in alignment in the present example as shown in FIGS. 11(*a*) and 11(*b*). There are reasons for such a shift. That is, as described above, originally the nozzle-hole $\mathbf{231}_{2108\text{-}1}$ is set to form the recorded-dot line $\mathbf{160}_{218\text{-}1\text{-}4}$ overlapping the recorded-dot line $\mathbf{160}_{219\text{-}96\text{-}2}$ formed by the nozzle-hole $\mathbf{231}_{2109\text{-}96}$. However, because of the above positional adjustment with respect to the second direction B, the setting is changed such that the nozzle-hole $\mathbf{231}_{2108\text{-}1}$ forms the recorded-dot line $\mathbf{160}_{218\text{-}2\text{-}4}$ overlapping the recorded-dot line $\mathbf{160}_{219\text{-}96\text{-}2}$. In addition, there may be a positional error between the adjacent head modules 210 from the beginning.

Figure 12A:
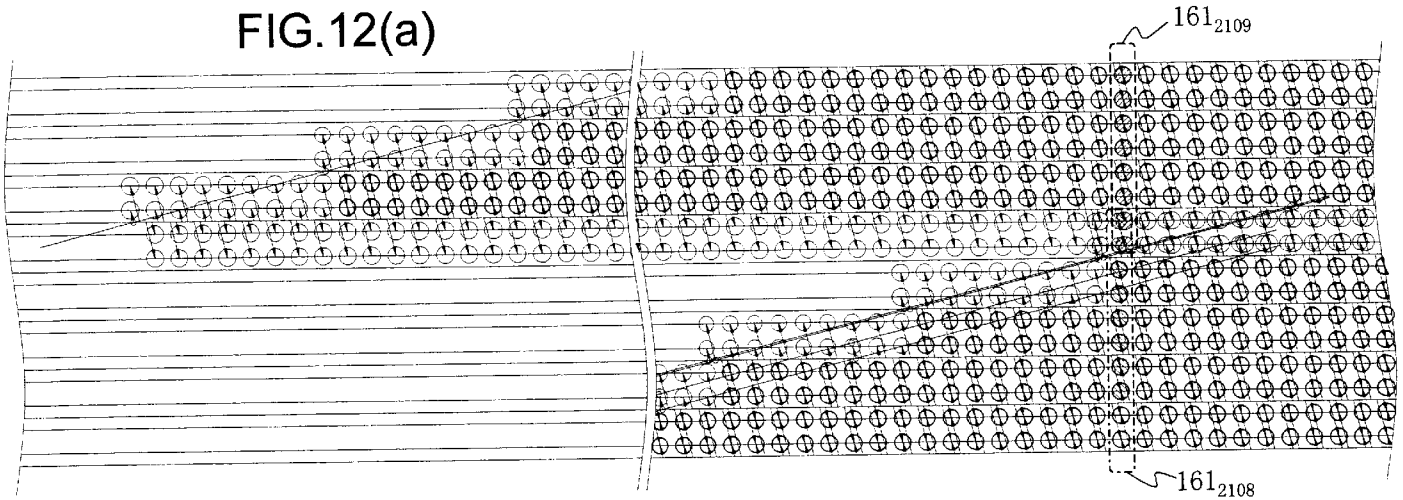
FIG. 12(*a*) is an explanatory view showing dots formed by adjusted printing operations.
Figure 12B:
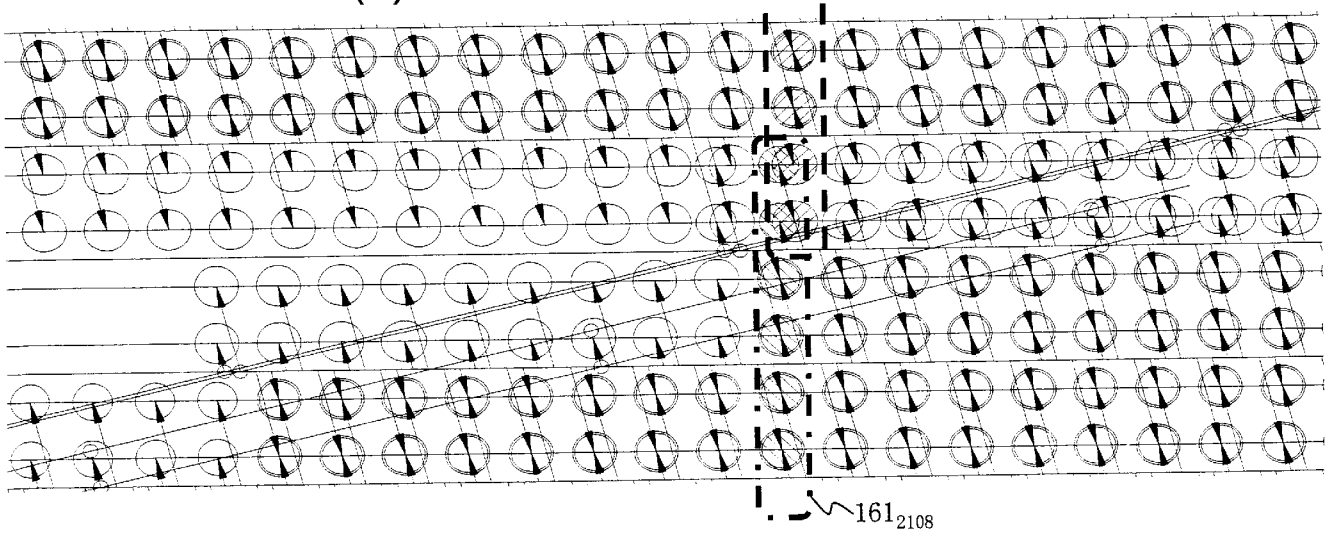

Such a positional shift is adjusted in the following manner. First, the PZT-driving-pulse timing adjusting unit 532 changes (delays) the PZT driving timing for nozzles 230 of the head module $\mathbf{210}_8$ by an amount of 6×4T, wherein T is an ink droplet ejection frequency (see FIG. 3). In this manner, the recorded-dot line $\mathbf{161}_{2108}$ is brought closer the recorded-dot line $\mathbf{161}_{2109}$ as shown in FIGS. 12(*a*) and 12(*b*).

Figure 13A:
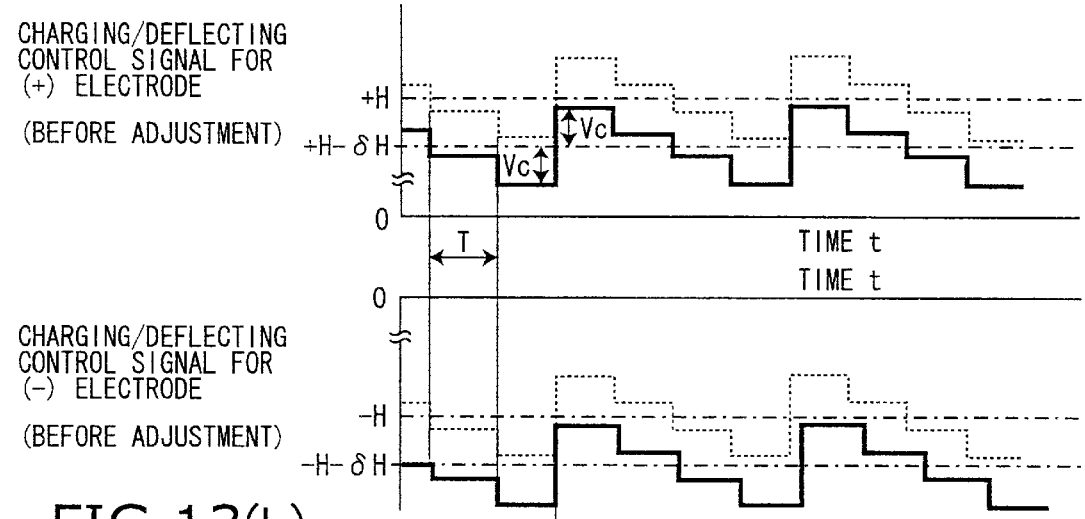
FIG. 13(*a*) is an explanatory view showing charging-deflection control signals before adjustment.
Figure 13B:
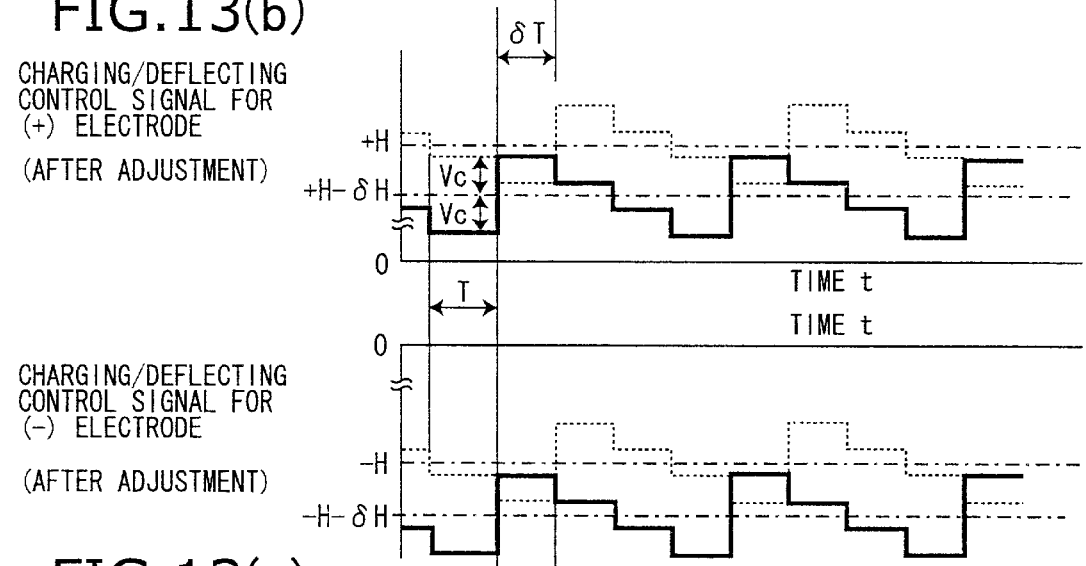
Figure 13C:
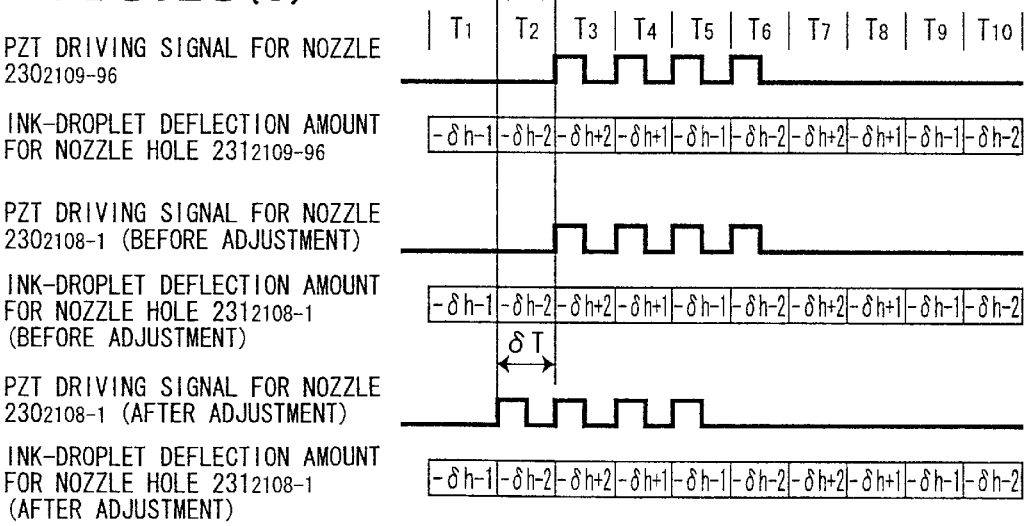

Then, the charging-deflection control signals are changed from that shown in FIG. 13(*a*) to that shown in FIG. 13(*b*) by shifting (advancing) the signals by δT. At the same time, the PZT-driving-pulse timing adjusting unit 532 changes the PZT driving timing for nozzles 230 of the head module 2109 by the amount of δT as shown in FIG. 13(*c*). As a result, the recorded-dot line $\mathbf{161}_{2108}$ is brought into alignment with the recorded-dot line $\mathbf{161}_{2109}$, and accordingly, the proper printing, such as that shown in FIG. 5, can be achieved.

Figure 14A:
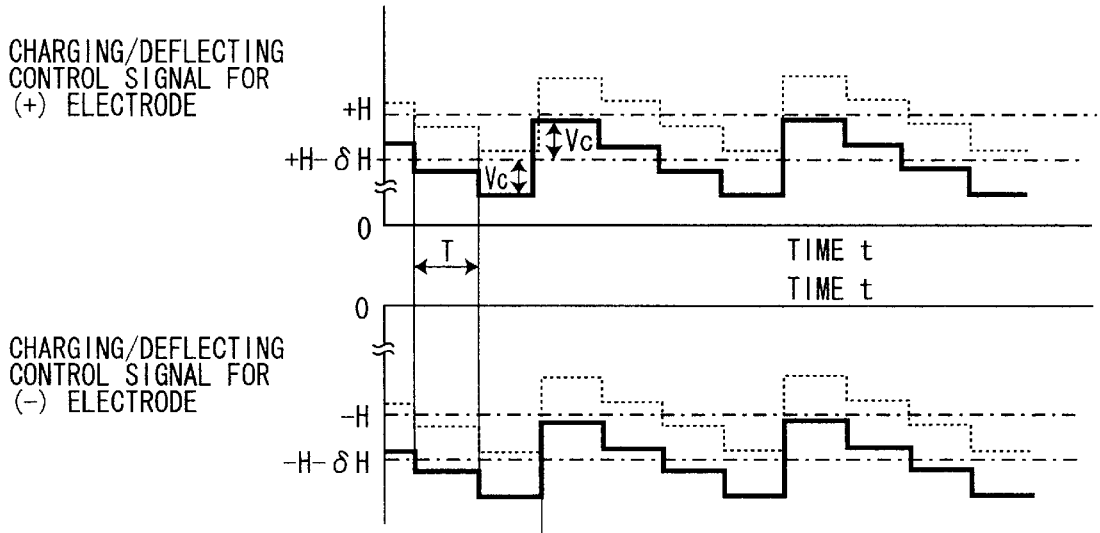
FIG. 14(*a*) is an explanatory view showing charging-deflection control signals.
Figure 14B:
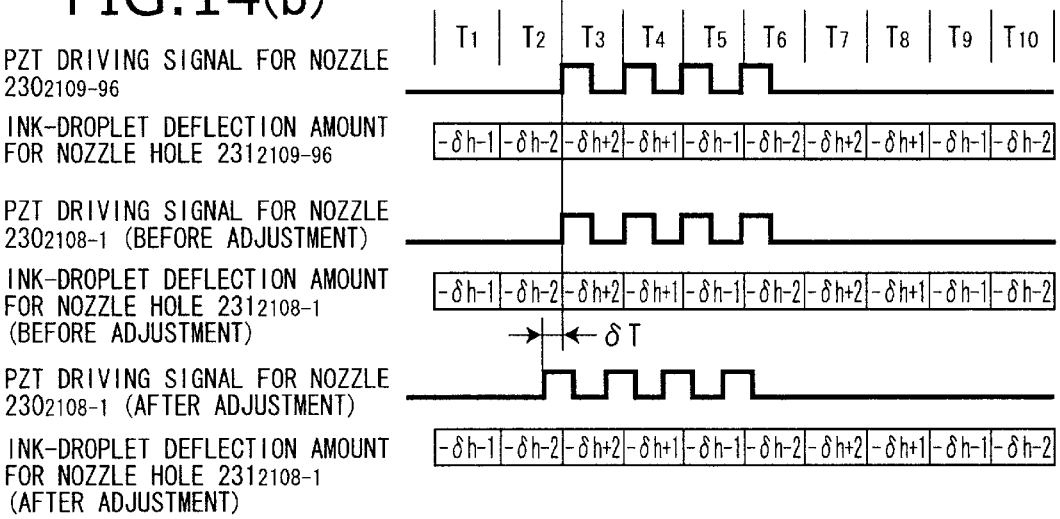

It should be noted that when the adjusting amount δT is relatively small, only the PZT driving timing to the nozzle 230 can be changed without changing the charging-deflecting control signals as shown in FIGS. 14(*a*) and 14(*b*). Needless to say, combinations of these are also available.

As described above, according to the present embodiment, the electrical adjustment provides a proper printing regardless of improper assembly of the head modules 210.

Figure 15:
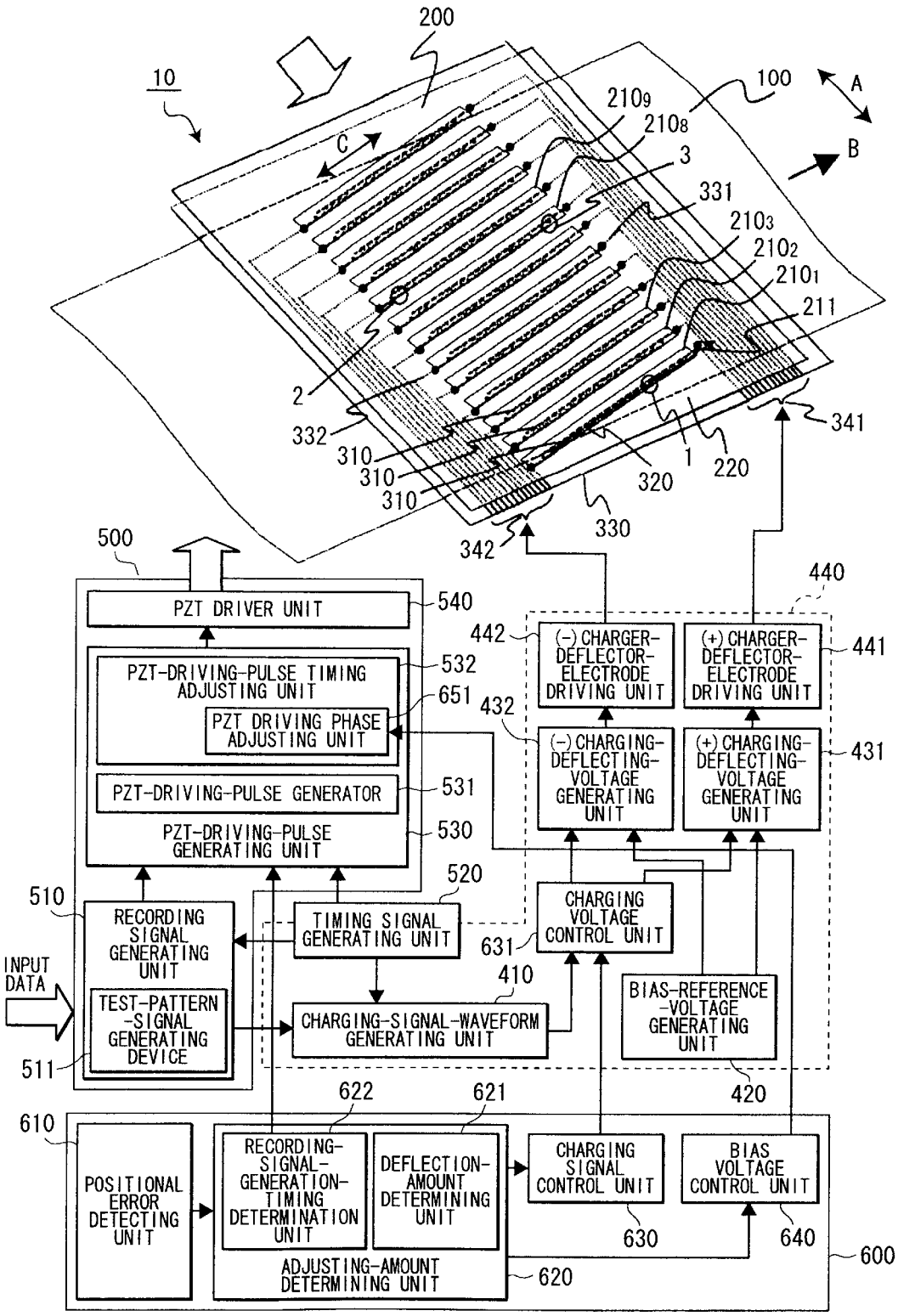
FIG. 15 is a plan view of main components, partially indicated in a block diagram, of an ink jet recording device according to a second embodiment of the present invention.

Next, an ink jet recording device 10' according to a second embodiment of the present invention will be described while referring to FIG. 15. Components and configurations similar to the above-described first embodiment are assigned with the same numberings and their explanations will be omitted.

The ink jet recording device 10' differs from the ink jet recording device 10 of the first embodiment in that the bias voltage control unit 640 is replaced by a PZT driving phase commanding device 650, that the bias voltage adjusting device 632 is dispensed with, and that a PZT driving phase adjustment device 651 is provided to the timing controller 532.

Figure 16A:
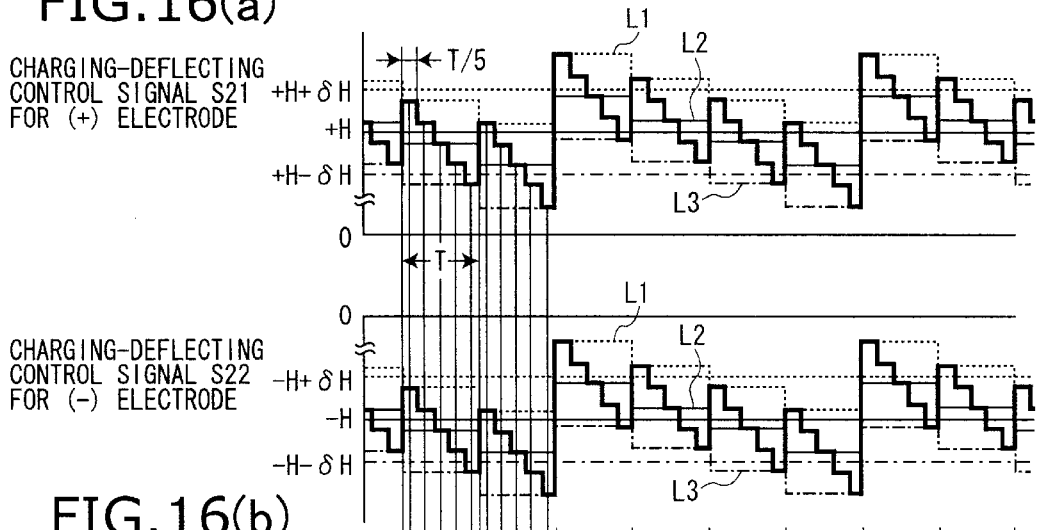
FIG. 16(*a*) is an explanatory view showing charging-deflection control signals applied to charger-deflector electrodes of the ink jet recording device of the second embodiment.
Figure 16B:
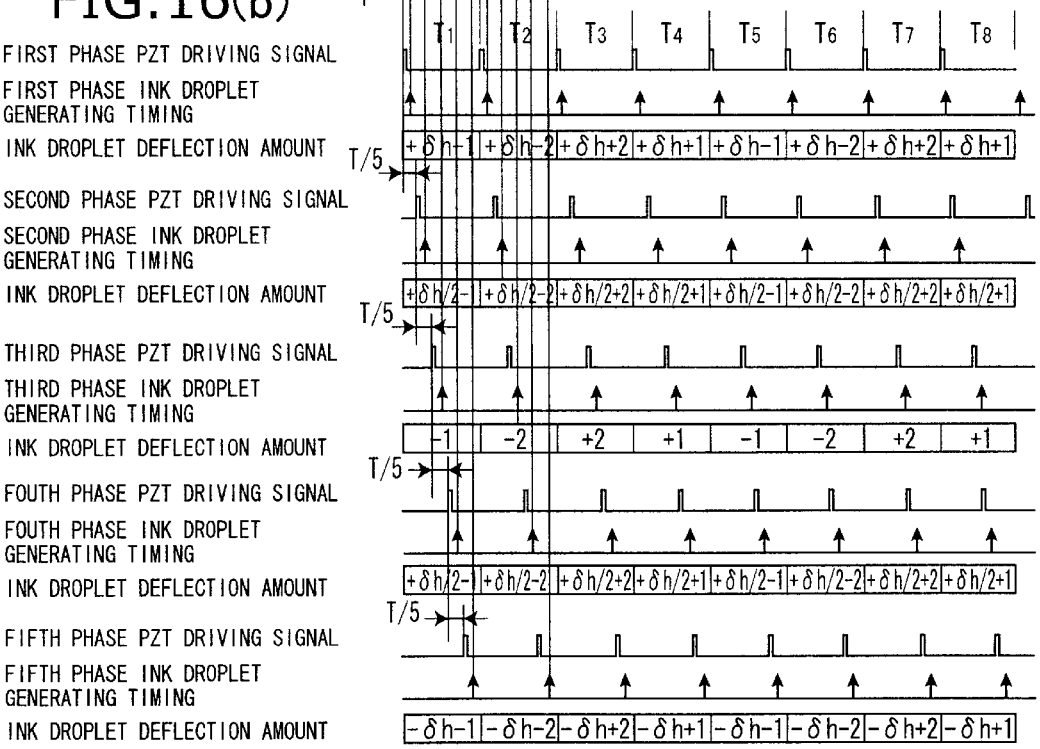

In the first embodiment, the center line E is shifted by changing the deflector voltage by the amount of δH. However, in the present second embodiment, the deflector voltage is maintained constant at +H as shown in FIGS. 16(*a*) and 16(*b*). A waveform of charging-deflection control signals S21, S22 differs from that of the first embodiment. That is, when the ink droplet generating frequency at the time of when the ink droplets ejection frequency is maximum possible is T, in the first embodiment shown in FIGS. 3(*a*) and 3(*b*) the waveform is changed by Vc/2 at every T forming a stepped waveform with frequency of 4T. However, in the present embodiment, the waveform is further changed by δH/2 at every T/5. In other words, the waveform takes five phases within T. Because the charging amount of the ink droplet 130 is determined by a voltage applied to the electrodes 310, 320 at the time of when an ink portion is separated from the remaining ink and ejected as an ink droplet 130 from a nozzle hole 231, the deflection amount is controlled in the following manner.

As shown in FIG. 16(*b*), when the nozzle 230 is driven at a first phase of the PZT driving signal waveform timing, an ink droplet 130 is generated by separating from the remaining ink at a first phase ink droplet generating timing indicated by arrows in FIG. 16(*b*), which is a predetermined time delayed from the nozzle driving. As a result, an ink droplet deflecting amount is adjusted by the amount of δh because of the charging-deflection control signals S21 and S22 shown in FIG. 16(*a*). Accordingly, the effect similar to that of the first embodiment can be obtained.

On the other hand, when the nozzle 230 is driven at a third phase of the PZT driving signal waveform timing, an ink droplet 130 is generated at a third phase ink droplet generating timing, which is a predetermined time after the nozzle driving. This provides the same effect on the charging amount as when the deflector voltage is set to H as in the first embodiment, which is indicated by a dotted line L2 in FIG. 16(*a*).

When the nozzle 230 is driven at a fifth phase PZT driving signal waveform timing shown in FIG. 16(*b*), an ink droplet 130 is generated at a fifth phase ink droplet generating timing, which is a predetermined time after the nozzle driving. Resultant ink droplet deflection amount is also shown in FIG. 16(*b*). This is equivalent to use of the charging-deflection control signal having the deflector voltage H−δH, which is indicated by the dotted line L3 shown in FIG. 16(*a*). Accordingly, the deflection shift adjustment of −δH is achieved.

When the nozzle 230 is driven at second or fourth phase PZT driving signal waveform timing shown in FIG. 16(*b*), an ink droplet 130 is generated at second or fourth phase ink droplet generating timing, which is a predetermined time after the corresponding nozzle driving timing. These are equivalent to use of the bias voltages of δH/2, −H/2δ, respectively, sot the deflection amount shift adjustments of δH/2, δH/2δ are achieved.

As described above, the adjustment is achieved by using the uniform charging-deflection control signal waveform. Therefore, the configuration of the ink jet recording device 10' will be simplified. Also, deflector voltage adjustment can be individually performed to each of nozzles 230 of a single head module 210.

While some exemplary embodiments of this invention have been described in detail, those skilled in the art will recognize that there are many possible modifications and variations which may be made in these exemplary embodiments while yet retaining many of the novel features and advantages of the invention.

For example, in the above-described embodiment, the frequency T is equally divided into five time units, and the voltage value of the charging-deflecting control signal is changed at every time unit. However, the dividing method of the frequency T is not limited to this. When the frequency T is divided into relatively small time units, fine adjustment can be achieved. However, it should be noted that in this case the fluctuation in the ink droplet generating phase needs to be strictly controlled.

Also, the ink droplet ejected from a single nozzle hole is deflected in one of four levels. However, the number of the deflection level can be less or more than four. There is no limitation in the deflection level.

Further, the present invention is also adaptable in an on-demand ink jet device, which ejects ink toward the recording device without deflecting the same. In this case, the ejecting direction of the ink droplet is changed in the above-described electrical manner, that is, by using the charging deflection of the ink droplet, so as to properly controlling the positional relationship between the recorded-dot groups of each head module.

The present invention can be also adaptable to a serial canning type ink jet recording device not only the line scanning type ink jet recording device.

What is claimed is:

1. An ink jet recording device comprising:

a plurality of head modules assembled side by side in a widthwise direction for forming dot groups on a recording medium, the dot groups being aligned in the widthwise direction to form a complete image, each of the plurality of head modules being formed with a nozzle line extending in a line direction, the nozzle line including a plurality of nozzles through which ink droplets are ejected to form the corresponding dot group by forming corresponding dots on the recording medium;

a moving mechanism that moves the recording medium relative to the plurality of head modules in a moving direction at an angle θ with respect to the line direction, the moving direction being perpendicular to the widthwise direction, wherein a plurality of first scanning lines extending in the moving direction are defined on the recording medium;

ejection means for selectively ejecting ink droplets from the plurality of nozzles in an ejection direction at an ejection timing;

deflection means for deflecting the ejection direction of the ink droplets toward a deflection direction perpendicular to the line direction by one of predetermined deflection amounts; and correcting means for correcting positional error of the dot groups, the correcting means including first control means for controlling the predetermined deflection amounts so as to form the dots on the first scanning lines and second control means for controlling the ejection timing so as to adjust positions of the dots with respect to the moving direction.

2. The ink jet recording device according to claim 1, wherein the second control means controls the ejection timing after the first control means has controlled the predetermined deflection amounts.

3. The ink jet recording device according to claim 2, wherein the deflection means includes a charger that charges the ink droplets and a deflector that generates a deflector electrostatic field that deflects the ejection direction of the ink droplets charged by the charger.

4. The ink jet recording device according to claim 3, wherein the charger includes a charging electrode provided in common to the plurality of nozzles of the corresponding nozzle line by the side of and along the corresponding nozzle line, and application means for applying a charging voltage to the charging electrode and ink within the nozzles.

5. The ink jet recording device according to claim 3, wherein the deflector includes a deflector electrode provided common to the plurality of nozzles of the corresponding nozzle line by the side of and along the corresponding nozzle line, and application means for applying a deflector voltage to the deflector electrode.

6. The ink jet recording device according to claim 1, wherein the deflection means includes a plurality of pairs of electrodes for corresponding head modules, each pair of electrodes being provided in common to the plurality of nozzles of corresponding nozzle line by the side of and along the corresponding nozzle line, and application means for applying a charging voltage between the respective pairs of electrodes and ink within the nozzles and a deflector voltage to the respective pairs of electrodes.

7. The ink jet recording device according to claim 6, wherein the correcting means adjusts at least one of the charging voltage and the deflector voltage.

8. The ink jet recording device according to claim 7, wherein the charging voltage includes an AC voltage component and a DC bias voltage component, the AC voltage component changing its magnitude at an ink ejection frequency T, and the correcting means further includes voltage adjusting means for adjusting the DC bias voltage component.

9. The ink jet recording device according to claim 8, wherein the charging voltage has a waveform that changes every 1st through Nth time-segment of T/N at the ink ejection frequency T, N being integers, and the ejection means ejects the ink droplets at one of 1st through Nth time-segment.

10. The ink jet recording device according to claim 1, wherein the correcting means further includes a sensor that detects a distance between actual positions of the dots on the recording medium and target positions.

11. The ink jet recording device according to claim 1, wherein the ejection means includes pressure members that selectively generates pressure within the corresponding nozzles in response to a recording signal, thereby ejecting the ink droplets.

* * * * *